US012559819B2

(12) United States Patent
Okada et al.

(10) Patent No.: US 12,559,819 B2
(45) Date of Patent: Feb. 24, 2026

(54) PLATINUM-GROUP METAL RECOVERY METHOD, COMPOSITION CONTAINING PLATINUM-GROUP METALS, AND CERAMIC MATERIAL

(71) Applicant: UNIVERSITY OF FUKUI, Fukui (JP)

(72) Inventors: Takashi Okada, Fukui (JP); Yoshiya Taniguchi, Fukui (JP); Yuto Nishi, Fukui (JP)

(73) Assignee: UNIVERSITY OF FUKUI, Fukui (JP)

( * ) Notice: Subject to any disclaimer, the term of this patent is extended or adjusted under 35 U.S.C. 154(b) by 789 days.

(21) Appl. No.: 17/759,672

(22) PCT Filed: Jan. 29, 2021

(86) PCT No.: PCT/JP2021/003146
§ 371 (c)(1),
(2) Date: Jul. 28, 2022

(87) PCT Pub. No.: WO2021/153710
PCT Pub. Date: Aug. 5, 2021

(65) Prior Publication Data

US 2023/0083521 A1 Mar. 16, 2023

(30) Foreign Application Priority Data

Jan. 30, 2020 (JP) ..... 2020-013995

(51) Int. Cl.
*C22B 11/02* (2006.01)
*C22B 7/00* (2006.01)
*C22B 11/00* (2006.01)

(52) U.S. Cl.
CPC ..... *C22B 11/021* (2013.01); *C22B 7/003* (2013.01); *C22B 7/007* (2013.01); *C22B 11/04* (2013.01)

(58) Field of Classification Search
CPC ..... C22B 11/021
See application file for complete search history.

(56) References Cited

U.S. PATENT DOCUMENTS

2012/0000582 A1 1/2012 Manhardt et al.

FOREIGN PATENT DOCUMENTS

CN 1759194 A 4/2006
CN 101550500 A 10/2009
(Continued)

OTHER PUBLICATIONS

Nishi, Y. et al.: "Generation of water-soluble palladium in alkali borate medium", Department of Materials Science and Engineering, University of Fukui, Fukui 910-8507, Japan, 2019, 3 pages. (Year: 2019).*

(Continued)

*Primary Examiner* — Jophy S. Koshy
*Assistant Examiner* — Joshua S Carpenter
(74) *Attorney, Agent, or Firm* — NK Patent Law

(57) ABSTRACT

Provided is a platinum-group metal recovery method for efficiently recovering a platinum-group metal. The method for recovering a platinum-group metal includes an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

12 Claims, 12 Drawing Sheets

(56) References Cited

FOREIGN PATENT DOCUMENTS

| | | | | |
|---|---|---|---|---|
| CN | 102796864 | A | | 11/2012 |
| CN | 103429769 | A | | 12/2013 |
| CN | 105861851 | A | | 8/2016 |
| CN | 105907975 | A | | 8/2016 |
| CN | 110191925 | A | | 8/2019 |
| FR | 2494304 | A1 | | 5/1982 |
| JP | 5794533 | A | | 6/1982 |
| JP | 10195552 | A | | 7/1998 |
| JP | 200468082 | A | | 3/2004 |
| JP | 2005113193 | A | | 4/2005 |
| JP | 2005113253 | A | | 4/2005 |
| JP | 2008202063 | A | | 9/2008 |
| JP | 2009249740 | A | | 10/2009 |
| JP | 2010077499 | A | | 4/2010 |
| JP | 2011252217 | A | | 12/2011 |
| JP | 2012520392 | A | | 9/2012 |
| JP | 2013249494 | A | | 12/2013 |
| JP | 2014234551 | A | * | 12/2014 |
| KR | 20050002690 | A | * | 1/2005 |
| RU | 2083705 | C1 | | 7/1997 |
| RU | 2164255 | C2 | | 3/2001 |

OTHER PUBLICATIONS

English machine translation of KR 2005-0002690 A of LIM (Year: 2005).*

JPO, Office Action for corresponding Japanese Patent Application No. 2021-574133, mailed Dec. 3, 2024, 9 pages.

CNIPA, Second Office Action for corresponding Chinese Patent Application No. 202180012033.6 issued on Feb. 22, 2024, 12 pages.

ISA/JP, International Search Report for corresponding PCT Patent Application No. PCT/JP2021/003146, mailed Apr. 6, 2021, 4 pages.

WIPO, International Preliminary Report on Patentability for corresponding PCT Patent Application No. PCT/JP2021/003146, dated Jul. 28, 2022, 7 pages.

Okada, T. et al.: "Reactivity of metallic palladium in a K2CO3—K2O—B2O3—Al2O3 melt", Results in Chemistry 2 (2020) 100077, 9 pages.

Okada, T. et al.: "Leaching characteristics of palladium heat-treated in a molten K2CO3—K2O—B2O3—Al2O3 media", Materials Chemistry and Physics 271 (2021) 124918, 7 pages.

Nishi, Y. et al.: "Generation of water-soluble palladium in alkali borate medium", Department of Materials Science and Engineering, University of Fukui, Fukui 910-8507, Japan, 2019, 3 pages.

Satake, Y. et al.: "Generation behavior of soluble rhodium compound in potassium borate", Faculty of Engineering, University of Fukui, 3-9-1 Bunkyo, Fukui 910-8507, Japan, 2020, 3 pages.

Okada, T. et al.: "Solubilization of palladium in molten mixture of sodium borates and sodium carbonate", Results in Physics 13 (2019) 102281, 3 pages.

CNIPA, First Office Action for corresponding Chinese Patent Application No. 2021800120336 issued on Oct. 28, 2023, 8 pages.

* cited by examiner

SECONDARY ELECTRON IMAGE

MAPPING IMAGE OF PALLADIUM

MAGNIFIED IMAGE OF PART P (SECONDARY ELECTRON IMAGE)

PLATINUM-GROUP METAL RECOVERY METHOD, COMPOSITION CONTAINING PLATINUM-GROUP METALS, AND CERAMIC MATERIAL

CROSS-REFERENCE TO RELATED APPLICATIONS

This application is a U.S. National Stage Application of International Patent Application No. PCT/JP2021/003146, filed on Jan. 29, 2021, which claims priority to Japanese Patent Application No. 2020-013995, filed on Jan. 30, 2020, the entire contents of all of which are incorporated by reference herein.

TECHNICAL FIELD

The present invention relates to a method for recovering a platinum-group metal, a platinum-group metal-containing composition, and a ceramic material in which a platinum-group metal is immobilized.

BACKGROUND ART

Platinum-group metals have excellent catalytic performance, and are therefore used in various applications such as catalysts for automobile exhaust gas purification and catalysts for fueled automobiles. Thus, platinum-group metals are industrially essential elements. However, production amounts of platinum-group metals are very small as compared with those of base metals, due to the scarcity of platinum-group metals. For example, even for Pt and Pd, which are relatively high in production amount among platinum-group metals, respective production amounts thereof are approximately 200 tons. In addition, primary sources of platinum-group metals are limited to South Africa, Russia, and the like. Therefore, if demands for platinum-group metals are increased due to development of a new material using a platinum-group metal, a supply shortage of platinum-group metals would occur. In other words, a risk concerning supply of platinum-group metals is currently high.

In order to deal with the risk concerning supply caused by such uneven distribution of resources, it is very important to extract and recover platinum-group metals from waste products such as waste catalysts generated in Japan. Moreover, mining and refining of natural ore are accompanied by a large environmental load. Therefore, if platinum-group metals can be efficiently extracted from waste products with higher concentrations of platinum-group metals than natural ore, such extraction would also lead to reduction of an environmental load. However, since platinum-group metals are chemically extremely stable, it is necessary, in a conventional dry process, to separate and concentrate a platinum-group metal from a waste product, and then dissolve the concentrate with a high concentration of acid. For this reason, energy consumption for the extraction of a platinum-group metal is large, and a chemical agent cost and a waste liquid treatment cost are also high. Therefore, there is an urgent need for development of a more efficient method for recovering a platinum-group metal. For example, Patent Literatures 1 through 4 and Non-Patent Literature 1 disclose conventional techniques relating to methods for recovering platinum-group metals.

CITATION LIST

Patent Literature

Patent Literature 1

Japanese Patent Application Publication, Tokukai, No. 2014-234551

Patent Literature 2

Japanese Patent Application Publication, Tokukai, No. 2011-252217

Patent Literature 3

Japanese Patent Application Publication, Tokukai, No. 2008-202063

Patent Literature 4

Japanese Patent Application Publication, Tokukai, No. 2013-249494

Non-Patent Literature

Non-patent Literature 1

Takashi Okada, Yoshiya Taniguchi, Fumihiro Nishimura, Susumu Yonezawa: Solubilization of palladium in molten mixture of sodium borates and sodium carbonate, Results in Physics, vol. 13, 2019, 102281

SUMMARY OF INVENTION

Technical Problem

The following description will discuss the conventional techniques disclosed in Patent Literatures 1 through 4 and problems thereof.

(1) Dissolution of Platinum-Group Metal with Aqua Regia

Patent Literature 1 discloses a method for dissolving a platinum-group metal using aqua regia. However, a chlorine gas, nitrosyl chloride, and the like generated in aqua regia are highly corrosive and toxic. Those gases promote corrosion of surrounding equipment, and therefore there is a cost for repairing corroded portions. Moreover, a large amount of neutralizer is needed to treat spent aqua regia, and it is also necessary to lower a nitrate ion concentration to be below the wastewater standard. Therefore, a process of wastewater treatment is complicated, and a cost of wastewater treatment is high.

In view of this, in order to avoid use of such deleterious aqua regia, the following aqua-regia-free process has been considered.

(2) Improvement of Platinum-Group Metal Solubility by Reaction Between Platinum-Group Metal and Active Metal Patent Literature 2 discloses a technique of causing a platinum-group metal to react with an active metal to obtain an alloy. By subjecting the obtained alloy to a chlorination treatment or an oxidation treatment, a complex compound of a chloride or oxide of the platinum-group metal and a chloride is generated. By treating this complex compound with brine, the platinum-group metal can be extracted. However, the process is complicated because the steps such as alloying of the platinum-group metal with the active metal and the chlorination or oxidization treatment of the alloy are needed. In addition, Mg, Ca, Zn, Fe, Na, K, Pb, Li, and the like used as active metals have extremely high reactivity and cause corrosion of surrounding equipment.

(3) Improvement of Platinum-Group Metal Solubility by Reaction Between Platinum-Group Metal and Chlorine Gas Patent Literature 3 discloses a technique in which a platinum-group metal is reacted with a chlorine gas in a molten salt to convert the platinum-group metal into a chloride that is readily soluble in water, in order to simplify the process of the technique of (2) above. However, in order to convert a platinum-group metal into a chloride, it is necessary to cause the platinum-group metal to react with a large amount of a chlorinating agent such as a chlorine gas. Therefore, corrosion of a reactor and surrounding equipment by the introduced chlorinating agent progresses, and a cost for repairing corroded portions is high.

(4) Improvement of Platinum-Group Metal Solubility by Reaction Between Platinum-Group Metal and Alkali Metal Carbonate Patent Literature 4 discloses a technique for forming a soluble complex oxide of a platinum-group metal by causing the platinum-group metal to react with an alkali metal carbonate. The complex oxide thus prepared is highly soluble in hydrochloric acid. Therefore, the complex oxide can be dissolved with hydrochloric acid of 12M instead of aqua regia. However, an acid concentration necessary for dissolution is still high, and a wastewater neutralization cost is high. In addition, a hydrogen chloride gas with high corrosivity is generated from hydrochloric acid with high concentration. Therefore, corrosion of surrounding equipment by the hydrogen chloride gas also causes a problem.

(5) Elution of Platinum-Group Metal in Aqueous Solvent

In order to solve the problems of (1) through (4) described above, the inventors of the present invention have developed a method in which a platinum-group metal is heated in a molten oxide to produce a water-soluble platinum-group compound, and the platinum-group compound is eluted in an aqueous solvent (Non-Patent Literature 1). In this method, the process is carried out in which the molten oxide containing the water-soluble platinum-group compound is immersed in the aqueous solvent to elute the platinum-group metal in the aqueous solvent. Therefore, in the obtained aqueous solvent, salts and the like derived from the molten oxide are contained with high concentrations, in addition to the platinum-group compound. Therefore, it is demanded to develop a technique for efficiently recovering a platinum-group metal from a molten oxide containing a water-soluble platinum-group compound.

An object of an aspect of the present invention is to provide a platinum-group metal recovery method for efficiently recovering a platinum-group metal.

Solution to Problem

In order to attain the object, a method for recovering a platinum-group metal in accordance with an aspect of the present invention includes: an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

In order to attain the object, a platinum-group metal-containing composition in accordance with an aspect of the present invention contains a platinum-group metal and an amphoteric element, a contained amount of the platinum-group metal being not less than 99% by weight, and a contained amount of the amphoteric element being not more than 1% by weight, where a total amount of the platinum-group metal and the amphoteric element is 100% by weight.

In order to attain the object, a ceramic material in accordance with an aspect of the present invention includes an immobilization layer that contains O and an alkali metal, the immobilization layer being formed on a surface of the ceramic material, and a platinum-group metal being immobilized in the immobilization layer.

Advantageous Effects of Invention

According to an aspect of the present invention, it is possible to provide a platinum-group metal recovery method for efficiently recovering a platinum-group metal.

DESCRIPTION OF EMBODIMENTS

Figure 1:
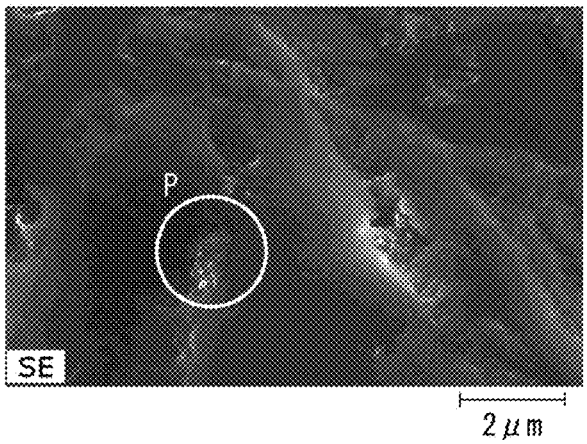
FIG. 1 is a diagram showing SEM-EDS images of a surface of an aluminum oxide block in one Example.
Figure 1:
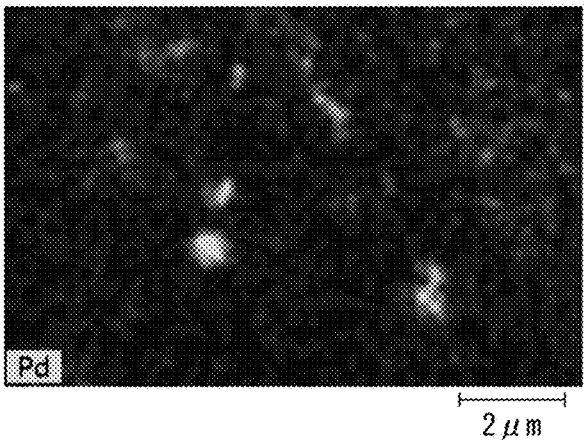
Figure 1:
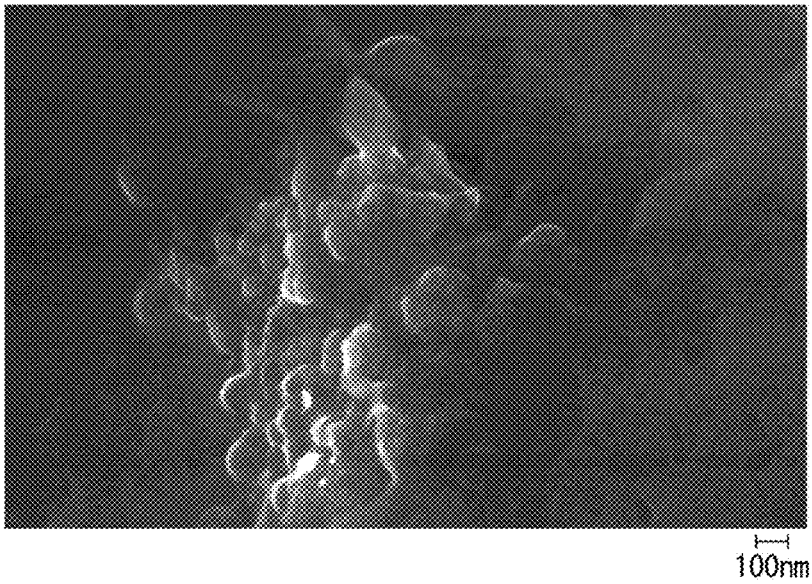

The following description will discuss details of an embodiment of the present invention with reference to the drawings. Note that the following descriptions are aimed merely at better understanding of the gist of the invention, and do not limit the present invention unless otherwise specified. The expression "A to B", representing a numerical range, herein means "not less than A and not more than B" unless otherwise specified in this specification.

1. Overview of Method for Recovering Platinum-Group Metal

The inventors of the present invention have found the following features, and accomplished the present invention based on the finding: (i) a water-soluble platinum-group metal (platinum-group compound) is efficiently immobilized on a ceramic material; and (ii) a platinum-group compound immobilized on a ceramic material is efficiently eluted from the ceramic material by an aqueous solvent.

The method for recovering a platinum-group metal in accordance with an embodiment of the present invention includes: an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

In a case where a platinum-group metal contained in a raw material is converted into a molten product containing an oxide and a carbonate or hydroxide of an alkali metal, the platinum-group metal is oxidized by reacting with the oxide and the carbonate or hydroxide of an alkali metal, and thus becomes an oxidation product of the platinum-group metal. The oxidation product is a water-soluble platinum-group compound, and is efficiently immobilized on the ceramic material. Thus, the platinum-group compound can be separated from salts (e.g., an alkali metal and boric acid), and the like derived from the molten product.

As described above, the platinum-group compound immobilized on the ceramic material is water-soluble. When the ceramic material on which the platinum-group compound is immobilized is brought into contact with an aqueous solvent, the platinum-group compound is eluted from the ceramic material to the aqueous solvent. Thus, the platinum-group compound can be further separated from salts and the like derived from the molten product.

According to an aspect of the present invention, intrusion of salts and the like into an aqueous solvent can be greatly reduced. Therefore, it is possible to reduce a cost for treating the aqueous solvent after recovering a platinum-group metal.

As indicated in Examples described later, in a case where a type of an aqueous solvent is altered, elution efficiency of a platinum-group compound in the aqueous solvent varies. Therefore, by selecting the type of the aqueous solvent, an intended platinum-group metal can be selectively recovered. Further, by carrying out an organic solvent treatment with respect to an aqueous solvent containing a platinum-group compound according to, for example, a conventional technique, an intended platinum-group metal can be selectively recovered.

2. Immobilization Step

2-1. Preparation of Molten Product

In obtaining the platinum-group compound described above, a molten product containing a platinum-group metal, a carbonate or hydroxide of an alkali metal, and an oxide is prepared. In the molten product, the platinum-group metal is oxidized to become a water-soluble platinum-group compound. Then, the molten product containing the platinum-group compound is brought into contact with a ceramic material to immobilize the platinum-group compound on the ceramic material.

It is possible that such a molten product is molten products separately prepared by respectively heating (i) a platinum-group metal (e.g., a raw material containing a platinum-group metal), (ii) a carbonate or hydroxide of an alkali metal, and (iii) an oxide, and the molten products of the respective (i) through (iii) above are brought into contact with a ceramic material. Alternatively, it is possible that, after obtaining a mixture of any two of (i) through (iii) above, the mixture is heated to be a molten product, and the remaining one material is heated to obtain a molten product, and then the molten products are brought into contact with a ceramic material. Alternatively, it is possible that, after obtaining a mixture of the three of (i) through (iii) above, the mixture is heated to obtain a molten product, and then the molten product is brought into contact with a ceramic material. Alternatively, it is possible that a mixture of the three of (i) through (iii) above and a ceramic material is obtained, then the mixture is heated to obtain a molten product, and thus the molten product is brought into contact with the ceramic material.

According to the method in which the materials (i) through (iii) above are separately converted into the respective molten products, for example, a degree of freedom in a process of carrying out the immobilization step is increased (e.g., molten products of respective materials other than a platinum-group metal can be prepared in advance). According to the method in which the molten product is obtained from the mixture of the three materials (i) through (iii) above, it is possible to collectively carry out heating for obtaining the molten product, and it is therefore possible to reduce a time taken for the immobilization step and to reduce a heating cost. According to the method in which the molten product is obtained from the mixture of the three materials (i) through (iii) above and the ceramic material, it is possible to further reduce a time taken for the immobilization step and a heating cost.

Examples of the platinum-group metal include Pd, Pt, Rh, Ir, Os, and Ru. Examples of a raw material containing such a platinum-group metal include a waste automotive catalyst, an electronic device scrap, and the like.

Examples of the alkali metal in the carbonate or hydroxide of an alkali metal include Na, K, Li, Rb, and Cs. From the viewpoint of more efficiently converting a platinum-group metal into a water-soluble platinum-group compound, among those, Na and K are preferable, and K is more preferable. The carbonate or hydroxide of an alkali metal can be used alone or as a mixture containing a plurality of types thereof.

The oxide can be, for example, at least one selected from the group consisting of $Na_2O$, $B_2O_3$, $K_2O$, $SiO_2$, $Li_2O$, $Rb_2O$, $Cs_2O$, and $P_2O_5$. Examples of such an oxide include glass (e.g., waste glass) and the like. According to a configuration in which glass is used as the oxide, it is possible to effectively utilize glass that can be procured at low cost. The oxide can be used alone or as a mixture of a plurality of types of oxides. In a case where the oxide is used as a mixture of a plurality of types of oxides, and the mixture contains at least $B_2O_3$, it is possible to more reliably convert a platinum-group metal into a water-soluble platinum-group compound.

The carbonate or hydroxide of an alkali metal functions as an oxidizer for oxidizing a platinum-group metal. Moreover, the oxide functions as a reaction aid for oxidizing a platinum-group metal.

The raw material containing a platinum-group metal, the carbonate or hydroxide of an alkali metal, and the oxide are heated and mixed as a molten product to oxidize the platinum-group metal, and thus an oxidation product of the platinum-group metal is obtained. Hereinafter, a simple term "molten product" indicates a molten product containing three materials, i.e., a raw material containing a platinum-group metal, a carbonate or hydroxide of an alkali metal, and an oxide. However, the molten product in accordance with an embodiment of the present invention is not limited to this, as described above.

2-2. Contact of Molten Product with Ceramic Material

The ceramic material to be brought into contact with the molten product only needs to be a sintered body obtained by heat-treating an inorganic material, and a specific structure of the ceramic material is not limited. The ceramic material to be brought into contact with the molten product is preferably a metal oxide-based ceramic material. Such a ceramic material can immobilize a water-soluble platinum-group compound more efficiently. The ceramic material can contain aluminum oxide, zeolite, zirconia, silica, iron oxide, cobalt oxide, nickel oxide, a mixture of two or more substances selected from these, or the like.

From the viewpoint of more efficiently converting a platinum-group metal into a water-soluble platinum-group compound, the ceramic material is preferably a ceramic material containing an amphoteric element (e.g., aluminum oxide, or the like). From such a ceramic material, the amphoteric element becomes an oxoanion and is eluted in the molten product. By bringing the molten product into contact with the ceramic material in the presence of such an oxoanion of the amphoteric element, an oxidation product of the platinum-group metal reacts with the oxoanion, and water solubility of the oxidation product is easily improved. In a case where the water solubility of the oxidation product is improved, the platinum-group compound can be eluted from the ceramic material more efficiently in an elution step described later. Examples of the amphoteric element include Al, Ti, V, Co, and Zr. Among these, Al and Ti are more preferable. Specific examples of the oxoanion of the amphoteric element include $AlO_2^-$, $TiO_3^{2-}$, $VO_4^{3-}$ and $CoO_2^-$.

From the viewpoint of efficiently immobilizing a platinum-group compound, the ceramic material is preferably a porous material having a large surface area. In a case where the ceramic material contains an oxide of an amphoteric element, it is preferable that the ceramic material is porous also from the viewpoint of promoting elution of an oxoanion.

Immobilization of a platinum-group compound on the ceramic material can include: (a) bringing the ceramic material into contact with a molten product to cause the ceramic material to adsorb a platinum-group compound contained in the molten product; (b) causing a component eluted from the ceramic material and a platinum-group compound to coprecipitate (more specifically, causing a component eluted from the ceramic material, a platinum-group compound, and the ceramic material to coprecipitate); or (c) both (a) and (b) described above. According to the above (a), the ceramic material which has adsorbed the platinum-group compound is taken out from the molten product, and then the platinum-group compound can be eluted from the ceramic material. In this case, it is preferable that the ceramic material is formed into a spherical shape, a bar shape, a plate shape, or the like from the viewpoint of easiness in taking-out. Meanwhile, according to the above (b), it is possible to easily separate the platinum-group compound, which has coprecipitated with the component eluted from the ceramic material, from the molten product by removing the molten product from the platinum-group compound coprecipitated with the component eluted from the ceramic material, and after the separation, the platinum-group compound can be eluted from the ceramic material. In this case, it is preferable that the shape of the ceramic material is a fine powder form, granular form, or the like from the viewpoint of efficient coprecipitation. In a case where a powdery ceramic material is used, it is preferable to introduce an appropriate amount of the powdery ceramic material to facilitate separation of the ceramic material from a molten product. According to the configuration, it is possible to further prevent the powdery ceramic material and a molten product oxide from reacting with each other to be solidified.

Examples of the component eluted from the ceramic material in the molten product include an oxoanion of an amphoteric element contained in the ceramic material.

Specific examples of the oxoanion of an amphoteric element include $AlO_2^-$, $AlO_4^{5-}$, $AlO_5^{7-}$, $AlO_6^{9-}$, $TiO_3^{2-}$, $VO_4^{3-}$ and $CoO_2^-$.

Contacting of the ceramic material with the molten product is preferably carried out during heating. In this case, the contacting of the ceramic material with the molten product is preferably carried out at a temperature of 600° C. to 1100° C., and more preferably at a temperature of 800° C. to 1100° C. According to such a configuration, a cost for heating can be reduced. According to an embodiment of the present invention, a platinum-group metal can be converted into a water-soluble platinum-group compound under mild conditions. Therefore, an upper limit of the heating temperature can be 1000° C., 900° C., or 800° C. The heating temperature can be appropriately selected in accordance with a composition of materials contained in the molten product.

A time period of the heating is preferably 30 minutes or more, more preferably 60 minutes or more, and still more preferably 120 minutes. Contacting of the ceramic material with the molten product can be carried out at any timing during the heating. Moreover, an appropriate time period can be appropriately selected for the heating in accordance with a composition of materials contained in the molten product. The heating is preferably carried out in an atmosphere containing oxygen, e.g., in the air, in order to promote oxidation of a platinum-group metal.

In contacting of the ceramic material with the molten product, a composition of materials in the molten product and/or a partial pressure of oxygen in the atmosphere when the ceramic material is brought into contact with the molten product can be appropriately adjusted. Thus, it is possible to adjust elution property when the platinum-group compound is eluted from the ceramic material in an aqueous solvent.

For example, by adjusting the elution property of the platinum-group compound in the aqueous solvent by altering basicity of the molten product and/or partial pressure of oxygen in the atmosphere when the ceramic material is brought into contact with the molten product, it is possible to adjust an amount of the platinum-group compound eluted from the ceramic material.

It is preferable that a pipe for supplying a gas containing oxygen is immersed in the molten product, a gas containing oxygen is supplied through the pipe into the molten product, and the molten product is heated while being stirred by bubbling.

It is preferable to add a high valent cation to the molten product to further increase power of oxidizing the platinum-group metal. Examples of the high valent cation include $Fe^{3+}$, $Ce^{4+}$ and $Gd^{3+}$.

It is preferable to use a container containing an amphoteric element such as an alumina crucible as a container used when bringing the ceramic material into contact with the molten product. Thus, the amphoteric element contained in the container becomes an oxoanion and can be eluted in the molten product. In a case where the ceramic material contains an amphoteric element, a container formed of a metal such as stainless steel and/or titanium can be used as the above container.

As a container for the molten product, a container formed of a ceramic material can be used. That is, causing a molten product of a raw material containing a platinum-group metal, a molten product of a carbonate or hydroxide of an alkali metal, a molten product of an oxide, and a ceramic material to make contact with each other in an embodiment of the present invention can be the contacting of the container formed of a ceramic material with the molten product. In this case, the ceramic material forming the container can contain aluminum oxide, zeolite, zirconia, silica, iron oxide, cobalt oxide, nickel oxide, a mixture of two or more substances selected from these, or the like.

3. Elution Step

The method for recovering a platinum-group metal in accordance with an embodiment of the present invention includes, after the foregoing immobilization step, an elution step of bringing the ceramic material, on which the platinum-group compound has been immobilized, into contact with an aqueous solvent to elute the platinum-group compound from the ceramic material. The platinum-group compound immobilized on the ceramic material is water soluble. Therefore, by bringing the ceramic material into contact with an aqueous solvent, it is possible to easily elute the platinum-group compound in the aqueous solvent, and to obtain an eluate containing the platinum-group compound.

The immobilization step preferably encompasses separating the ceramic material, on which the platinum-group compound has been immobilized, from the molten product. Alternatively, it is preferable that the method for recovering a platinum-group metal in accordance with an embodiment of the present invention includes, between the immobilization step and the elution step, a separation step of separating the ceramic material, on which a platinum-group compound (the platinum-group metal) has been immobilized, from the molten product. Thus, salts of an oxide and the like contained in the molten product are hardly brought into the elution step. Therefore, it is possible to greatly reduce intrusion of salts of an oxide and the like into the aqueous solvent. As a method of separating the ceramic material from the molten product, a method of taking out the ceramic material from the molten product can be used. Alternatively, it is possible to employ a method of removing the molten product from the platinum-group compound, which has coprecipitated with a component eluted from the ceramic material in the molten product. Any other methods can be employed, as long as it is possible to separate the ceramic material from the molten product.

The aqueous solvent is intended to be a solvent containing water as a main component, for example, a solvent containing water in an amount of not less than 60% by weight, preferably not less than 70% by weight, more preferably not less than 80% by weight, more preferably 90% by weight, more preferably not less than 95% by weight, more preferably not less than 98% by weight, and most preferably 100% by weight. With such a configuration, the platinum-group compound can be easily eluted in the aqueous solvent.

An upper limit value of the amount of water contained in the aqueous solvent is not particularly limited, and can be, for example, 80% by weight, 90% by weight, or 100% by weight. It is preferable that the aqueous solvent is an aqueous solution of an acid. Examples of a type of the acid include organic acids such as citric acid, malic acid, acetic acid, and oxalic acid, and inorganic acids such as hydrochloric acid, nitric acid, sulfuric acid, boric acid, phosphoric acid, and perchloric acid. A concentration of the acid can be, for example, 3 mol/L or less, preferably 1 mol/L or less, more preferably 0.1 mol/L or less, and further preferably 0.01 mol/L or less. As for the concentration of the acid, an appropriate concentration can be selected in accordance with a type of the acid. The aqueous solvent does not need to contain an acid. With such a configuration, the platinum-group compound can be easily eluted in the aqueous solvent.

In addition to or other than the acid, the aqueous solvent can contain components other than water. As such a component, a polar solvent is preferable, and examples thereof include alcohols such as methanol and ethanol, or solutions containing a hydroxide complex of an amphoteric element.

In a case where the aqueous solvent is an aqueous solution of an acid, pH of the aqueous solvent can be 4 or less, preferably 3 or less, and more preferably 2 or less. The aqueous solvent does not need to be strongly acidic as aqua regia. Therefore, in a case where the aqueous solvent is an aqueous solution of an acid, pH can be 1 or more. By using such an aqueous solvent, not only a platinum-group compound can be efficiently eluted but also an adverse effect on nature can be prevented. In a case where the aqueous solvent does not contain an acid, pH of the aqueous solvent can be, for example, 6 to 8, can be 6 to 7, and can be 7 to 8.

In the elution step, it is possible that, after eluting the platinum-group compound from the ceramic material using the aqueous solvent, a newly prepared aqueous solvent is brought into contact with the ceramic material to carry out a similar process, and the platinum-group compound is further eluted. Further, this operation can be repeated to repeatedly elute the platinum-group compound. In such a method of repeating elution, a composition of an aqueous solvent in each of the repeated processes is not limited, and the composition of the aqueous solvent can vary for each of the repeated processes. For example, it is possible that the platinum-group compound is eluted with an aqueous solvent containing not less than 98% by weight of water, and then the platinum-group compound is further eluted with an aqueous solvent containing not less than 80% by weight and not more than 90% by weight of water.

In a case where the operation of eluting the platinum-group compound is carried out repeatedly and using aqueous solvents of different compositions, different kinds of platinum-group compounds can be eluted in a stepwise manner. For example, in a case where the immobilization step is carried out using a raw material containing a plurality of types of platinum-group metals, the plurality of types of platinum-group compounds are immobilized on the ceramic material. At this time, for example, it is possible that, after eluting a platinum-group compound A with an aqueous solvent containing not less than 98% by weight of water, a platinum-group compound B is further eluted with an aqueous solvent containing not less than 80% by weight and not more than 90% by weight of water. Thus, it is possible to elute different types of platinum-group compounds in aqueous solvents having different compositions, respectively. Aqueous solvents used in the respective repeated processes can be, for example, different aqueous solvents prepared by altering the concentration of the acid, and can be different aqueous solvents prepared by altering the type of the acid.

By adjusting a composition of the molten product in the immobilization step, e.g., by increasing or decreasing an amount of an oxide contained in the molten product, it is possible to adjust elution property of the platinum-group compound from the ceramic material in an aqueous solvent in the elution step. For example, an amount of an oxide can be adjusted so that a platinum-group compound is suitably dissolved in an aqueous solvent containing not less than 98% by weight of water. Moreover, by reducing the amount of the oxide contained in the molten product, it is possible to carry out adjustment so that the platinum-group compound is eluted more suitably in an aqueous solvent containing not less than 80% by weight and not more than 90% by weight of water, as compared with a case where the platinum-group compound is dissolved in an aqueous solvent containing not less than 98% by weight of water.

In order to adjust elution property of the platinum-group compound, in the immobilization step, an oxidizer different from the carbonate or hydroxide of an alkali metal can be contained in the molten product. Examples of such an oxidizer include air, an oxygen gas, a hydrogen peroxide solution, and a solution containing a high valent cation. Among those oxidizers, the oxygen gas or the high valent cation is preferable because these oxidizers have an advantage of being able to rapidly oxidize a platinum-group metal. Examples of the high valent cation include $Fe^{3+}$, $Ce^{4+}$, and $Co^{3+}$.

Such an oxidizer is preferably introduced into the molten product prior to or during heating of the molten product. Due to the presence of the oxidizer during heating, oxidation of a platinum-group metal proceeds effectively. Note that a time at which the oxidizer is introduced is not limited to this, and can be after the molten product is heated, and can be during elution of the platinum-group compound in the aqueous solvent.

4. Extraction Step

The method for recovering a platinum-group metal in accordance with an embodiment of the present invention can include an extraction step of extracting a platinum-group metal in an organic solvent from an eluate obtained in the foregoing elution step. This step can be carried out by a process of extracting a platinum-group metal by a conventional organic solvent treatment.

According to such a platinum-group metal extraction process, a platinum-group metal in waste catalysts and scraps can be selectively extracted in a low corrosive environment without using an acidic solvent such as deleterious aqua regia or a highly-concentrated hydrochloric acid.

Examples of the organic solvent include dialkyl sulfide, hydroxyoxime, 8-quinolinol, tertiary amine and trialkylphosphate. In a case where hydroxyoxime is used as the organic solvent, in particular, Pd can be selectively extracted among platinum-group metals. In a case where tertiary amine is used as the organic solvent, in particular, Pt can be selectively extracted among platinum-group metals. In a case where Pd and Pt are extracted from the eluate and then tertiary amine is used as the organic solvent, in particular, Ir can be selectively extracted among the remaining platinum-group metals. Further, Rh can be obtained by purifying the eluate after the extraction. Ru and Os can be volatilized and separated by distillation operation during those separation processes.

5. Platinum-Group Metal-Containing Composition

The platinum-group metal-containing composition in accordance with the present embodiment contains a platinum-group metal and an amphoteric element, and a contained amount of the platinum-group metal is not less than 99% by weight, and a contained amount of the amphoteric element is not more than 1% by weight, where a total amount of the platinum-group metal and the amphoteric element is 100% by weight.

Examples of the platinum-group metal include Pd, Pt, Rh, Ir, Os, and Ru.

Examples of the amphoteric element include Al, Ti, V, Co, and Zr. Among these, Al and Ti are more preferable.

A method for obtaining such a platinum-group metal-containing composition includes, but is not limited to, processes described in, for example, <2. Immobilization step> and <3. Elution step> described above. Thus, the method for recovering a platinum-group metal in accordance with an embodiment of the present invention can be said to be a method for producing a platinum-group metal-containing composition. That is, the method for recovering a platinum-group metal in accordance with an embodiment of the present invention can be said to be a method for producing a platinum-group metal-containing composition, including a method for recovering a platinum-group metal, including: an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

Specific examples of the platinum-group metal-containing composition include a composition in which a platinum-group metal is eluted in an aqueous solvent. The aqueous solvent is intended to be a solvent containing water as a main component, for example a solvent containing water in an amount of not less than 60% by weight, preferably not less than 70% by weight, more preferably not less than 80% by weight, more preferably 90% by weight, more preferably not less than 95% by weight, more preferably not less than 98% by weight, and most preferably 100% by weight. An upper limit value of the amount of water contained in the aqueous solvent is not particularly limited, and can be, for example, 80% by weight, 90% by weight, or 100% by weight. It is preferable that the aqueous solvent is an aqueous solution of an acid. Examples of a type of the acid include organic acids such as citric acid, malic acid, acetic acid, and oxalic acid, and inorganic acids such as hydrochloric acid, nitric acid, sulfuric acid, boric acid, phosphoric acid, and perchloric acid. A concentration of the acid can be, for example, 3 mol/L or less, preferably 1 mol/L or less, more preferably 0.1 mol/L or less, and further preferably 0.01 mol/L or less. As for the concentration of the acid, an appropriate concentration can be selected in accordance with a type of the acid. The aqueous solvent does not need to contain an acid.

The platinum-group metal-containing composition can be, for example, an eluate of a platinum-group metal that contains, in an aqueous solvent, a platinum-group metal eluted from a ceramic material on which the platinum-group metal is immobilized and an amphoteric element, and a contained amount of the platinum-group metal is not less than 99% by weight, and a contained amount of the amphoteric element is not more than 1% by weight, where a total amount of the platinum-group metal and the amphoteric element is 100% by weight. With such a platinum-group metal-containing composition, it is possible to easily extract a platinum-group metal contained in the eluate by a process of extracting a platinum-group metal with a conventional organic solvent treatment. Moreover, the platinum-group metal-containing composition can be in a form in which the aqueous solvent is removed from the eluate of the platinum-group metal (e.g., a solid).

A method of obtaining a solid platinum-group metal-containing composition can be, for example, a method in which a concentration step is further carried out with respect to the eluate obtained in the <3. Elution step> described above.

In the concentration step, active carbon is immersed in the eluate, and a platinum-group compound is adsorbed on the active carbon. At this time, it is preferable to stir the eluate in which the active carbon is immersed. Then, the active carbon adsorbing the platinum-group compound is taken out from the eluate and heated to burn the active carbon. The heating of the active carbon is not limited as long as the heating is at a temperature at which the active carbon burns, and is, for example, at 1000° C. A concentrate obtained after heating of active carbon includes a concentrated platinum-group metal. Such a concentrate is an example of the platinum-group metal-containing composition in accordance with an embodiment of the present invention.

6. Ceramic Material on which Platinum-Group Metal is Immobilized

In the ceramic material in accordance with the present embodiment, an immobilization layer containing oxygen (O) and an alkali metal is formed on a surface of the ceramic material, and a platinum-group metal is immobilized in the immobilization layer.

For example, in a case where a molten product containing a platinum-group compound is brought into contact with a ceramic material by the process described in (2-1. Preparation of molten product) above, an immobilization layer is formed on the surface of the ceramic material. In the immobilization layer, a composite layer containing O and an alkali metal derived from a carbonate or hydroxide of an alkali metal is formed. Moreover, it is preferable that the immobilization layer further contains an element derived from an oxide contained in the molten product. Such an element derived from the oxide can be an element derived from a network forming oxide, or an element derived from a network modifying oxide, or elements derived from both of a network forming oxide and a network modifying oxide. The "network forming oxide" refers to an oxide that can form a network structure of glass when vitrified. The "network modifying oxide" refers to an oxide that can modify a network structure of glass when vitrified. Those oxides can be added in a vitrified form when obtaining a molten product containing a platinum-group compound. Note, however, that those oxides do not necessarily need to be vitrified.

The element derived from an oxide can be, for example, at least one selected from the group consisting of Na, B, K, Si, Li, Rb, Cs and P.

Examples of the immobilization layer include, but are not limited to, a K—Al—B—O composite layer (e.g., $K_2Al_2(BO_3)_2O$) when the ceramic material is aluminum oxide, the oxide contained in the molten product is $B_2O_3$ and $K_2O$, and the carbonate of an alkali metal is $K_2CO_3$. Another example of the immobilization layer can be a composite layer (e.g., an Na—Al—B—O composite layer) in which at least one atom constituting the K—Al—B—O composite layer is substituted by an atom having a similar property. The immobilization layer can be a K—Al—O composite layer containing no B derived from an oxide.

The inventors of the present invention have found that such an immobilization layer has a property capable of immobilizing a platinum-group metal. With this finding, the inventors of the present invention have obtained a ceramic material in which a platinum-group metal is immobilized on a surface thereof. A method for obtaining such a ceramic material on which a platinum-group metal is immobilized includes, but is not limited to, the process described in, for example, <2. Immobilization step> above.

Examples of the platinum-group metal immobilized on the ceramic material include Pd, Pt, Rh, Ir, Os, and Ru.

The ceramic material only needs to be a sintered body obtained by heat-treating an inorganic material, and a specific structure of the ceramic material is not limited. The ceramic material to be brought into contact with the molten product is preferably a metal oxide-based ceramic material. Such a ceramic material can immobilize a water-soluble platinum-group compound more efficiently. The ceramic material can contain aluminum oxide, zeolite, zirconia, silica, iron oxide, cobalt oxide, nickel oxide, a mixture of two or more substances selected from these, or the like.

From the viewpoint of efficiently immobilizing a platinum-group compound, the ceramic material is preferably a porous material having a large surface area.

The surface of the ceramic material can be any surface on which the ceramic material and a liquid (such as the molten product or the aqueous solvent) can be in contact with each other when the ceramic material is immersed in the liquid. For example, in a case where the ceramic material is porous, not only a surface visible in an external view of the ceramic material but also surfaces formed inside the pores are the surface of the ceramic material.

7. Aspects of the Present Invention can Also be Expressed as Follows

The method for recovering a platinum-group metal in accordance with an aspect of the present invention includes: an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

In the method for recovering a platinum-group metal in accordance with an aspect of the present invention, it is possible that: the immobilization step encompasses causing the ceramic material to adsorb the platinum-group metal or causing a component eluted from the ceramic material and the platinum-group metal to coprecipitate.

In the method for recovering a platinum-group metal in accordance with an aspect of the present invention, it is possible that: in the immobilization step, the raw material containing the platinum-group metal, the carbonate or hydroxide of the alkali metal, and the oxide are heated to obtain a molten product, and then the molten product is brought into contact with the ceramic material.

In the method for recovering a platinum-group metal in accordance with an aspect of the present invention, it is possible that: in the immobilization step, a mixture of the raw material containing the platinum-group metal, the carbonate or hydroxide of the alkali metal, the oxide, and the ceramic material is obtained, and then the mixture is heated to obtain a molten product such that the molten product is in contact with the ceramic material.

In the method for recovering a platinum-group metal in accordance with an aspect of the present invention, it is possible that: the ceramic material contains aluminum oxide, zeolite, zirconia, silica, iron oxide, cobalt oxide, or nickel oxide.

The method for recovering a platinum-group metal in accordance with an aspect of the present invention can further include: an elution step of bringing the ceramic material, on which the platinum-group metal has been immobilized in the immobilization step, into contact with an aqueous solvent to elute the platinum-group metal from the ceramic material.

In the method for recovering a platinum-group metal in accordance with an aspect of the present invention, it is possible that the aqueous solvent is an aqueous solution of an acid.

In the method for recovering a platinum-group metal in accordance with an aspect of the present invention, it is possible that: the contacting of the molten product with the ceramic material is carried out at a temperature of 600° C. to 1100° C.

In the method for recovering a platinum-group metal in accordance with an aspect of the present invention, it is possible that: the contacting of the molten product with the ceramic material is carried out in the presence of an oxoanion of an amphoteric element.

In the method for recovering a platinum-group metal in accordance with an aspect of the present invention, it is possible that the platinum-group metal is Pd, Pt, Rh, Ir, Os, or Ru.

In the method for recovering a platinum-group metal in accordance with an aspect of the present invention, it is possible that the alkali metal is Na, K, Li, Rb, or Cs.

In the method for recovering a platinum-group metal in accordance with an aspect of the present invention, it is possible that: the oxide is at least one selected from the group consisting of $Na_2O$, $B_2O_3$, $K_2O$, $SiO_2$, $Li_2O$, $Rb_2O$, $Cs_2O$, and $P_2O_5$.

The platinum-group metal-containing composition in accordance with an aspect of the present invention contains a platinum-group metal and an amphoteric element, and a contained amount of the platinum-group metal is not less than 99% by weight, and a contained amount of the amphoteric element is not more than 1% by weight, where a total amount of the platinum-group metal and the amphoteric element is 100% by weight.

The ceramic material in accordance with an aspect of the present invention includes an immobilization layer that contains O, an alkali metal, and at least one selected from the group consisting of Na, B, K, Si, Li, Rb, Cs and P, the immobilization layer being formed on a surface of the ceramic material, and a platinum-group metal being immobilized in the immobilization layer.

EXAMPLES

A. Immobilization of Platinum-Group Metal by Aluminum Oxide Block

A1. Sample and Method

A1-1. Reactive Medium

A $K_2O$—$B_2O_3$ medium, which is an example of the oxide of the present invention, was prepared as follows using a commercially available compound standard reagent. First, 5 g of boric acid and 2.1 g of potassium hydroxide were introduced into an alumina crucible having a capacity of 30 mL (hereinafter, referred to as "30 mL crucible"), and the 30 mL crucible was placed in an electric furnace. After that, a temperature in the electric furnace was raised to 1000° C. over 30 minutes, and the 30 mL crucible was heated for 1 hour while maintaining the temperature. Subsequently, a molten product generated in the 30 mL crucible was cooled. A resultant solidified matter was used as the $K_2O$—$B_2O_3$ medium.

Such a reactive medium containing boron oxide as a main component has a network structure in which a $BO_3$ structure of a plane triangle is a basic unit and the $BO_3$ structures are connected to each other in a network shape. In a case where $K_2O$ is contained in such a reactive medium, $BO_4$ having a tetrahedral structure is generated. $BO_4$ in a network structure is known to have a negative charge as a whole. Therefore, $BO_4$ in the network structure can be regarded as an oxoanion. It seems that, in a case where the reactive medium contains an oxoanion, it is possible to more efficiently convert a platinum-group metal into a platinum-group compound. Therefore, the $K_2O$—$B_2O_3$ medium was used as a reactive medium for converting a platinum-group metal into a platinum-group compound.

A1-2. Preparation of Platinum-Group Compound of Comparative Example

The $K_2O$—$B_2O_3$ medium prepared in (A1-1) above was mixed with a metal Pd and potassium carbonate (which is an example of the carbonate or hydroxide of an alkali metal of the present invention). A resultant mixture was added to the 30 mL crucible, and the 30 mL crucible was placed in a 100 mL alumina crucible (hereinafter, referred to as "100 mL crucible"). After that, the 100 mL crucible was covered with a lid, and the 100 mL crucible was heated in an electric furnace. Heating conditions are indicated in Table 1 below.

In a molten product obtained by the above heating, the metal Pd was oxidized by reaction with the potassium carbonate, and an oxidation product of the metal Pd was generated. The oxidation product was then dissolved in the $K_2O$—$B_2O_3$ medium. A product obtained by cooling such a molten product is defined as a heat treatment product.

TABLE 1

| | Conditions for preparing Pd compound | | | | |
|---|---|---|---|---|---|
| | $K_2O$—$B_2O_3$ medium (g) | Metal Pd (mg) | $K_2CO_3$ (g) | Heating temperature (° C.) | Heating time (min) |
| Comparative Example A1 | 1 | 10 | 3.9 | 1000 | 30 |
| Example A1 | 1 | 10 | 3.9 | 1000 | 30 |
| Example A2 | 1 | 10 | 3.9 | 1000 | 30 |
| Example A3 | 1 | 10 | 3.9 | 1000 | 60 |
| Example A4 | 1 | 10 | 3.9 | 1000 | 60 |

A1-3. Preparation of Platinum-Group Compound of Examples of Present Invention The $K_2O$—$B_2O_3$ medium prepared in (A1-1) above was mixed with a metal Pd and potassium carbonate. This mixture was introduced into a 10 mL alumina crucible (hereinafter, referred to as "10 mL crucible"), and the 10 mL crucible was placed in a 30 mL crucible. The 30 mL crucible was heated in an electric furnace. Heating conditions are indicated in Table 1. By the heating, as with the above (A1-2), a Pd compound which was an oxidation product of the metal Pd was dissolved in the $K_2O$—$B_2O_3$ medium. After that, an aluminum oxide block (which is an example of the ceramic material of the present invention) was immersed in a molten product in which the Pd compound was dissolved, and maintained for a predetermined time period. Subsequently, the aluminum oxide block was taken out from the molten product.

A1-4. Evaluation of Recovery Rate of Platinum-Group Compound

In order to evaluate an amount of the Pd compound immobilized in the aluminum oxide block, the following test was carried out. The crucible accommodating the heat treatment product (Comparative Examples) or the aluminum oxide block (Examples) was placed in a 200 mL beaker, and 150 mL of ion-exchanged water was added to the beaker (elution treatment). A stirring rod was immersed in the liquid in the beaker, and the liquid was stirred at a stirring speed of 7000 rpm for 2 hours. After that, the liquid (eluate) in the beaker was suction-filtered through a 1 μm paper filter. Meanwhile, for a solid (the aluminum oxide block or the heat treatment product) remaining in the beaker after filtration, an elution treatment, stirring, and filtration were carried out again in manners similar to those described above using a 0.01M hydrochloric acid aqueous solution (0.01M HCl). After that, an obtained solid was further subjected to an elution treatment, stirring and filtration in manners similar to those described above using a 0.1M hydrochloric acid aqueous solution (0.1M HCl) and a 1M hydrochloric acid aqueous solution (1M HCl) in sequence. A concentration of the Pd compound in each of the eluates obtained by the series of operations was measured by an ICP emission spectrometer, and a recovery rate of a platinum-group metal was determined from the following equation (1):

$$\text{Recovery rate (\%)} = \text{Amount of platinum-group compound in eluate} / \text{Amount of introduced platinum-group metal} \times 100 \quad (1)$$

A1-5. Conditions for Immobilizing Pd Compounds in Examples and Comparative Examples In order to clarify a relationship between the condition for immobilizing the Pd compound and the Pd recovery rate, as indicated in Table 2 below, an introduced amount of the aluminum oxide block into the molten product and an immersion condition of the aluminum oxide block into the molten product were varied in Examples A1 through A4. Meanwhile, in Comparative Example A1, no aluminum oxide block was introduced into the molten product, and the elution treatment was carried out with respect to the heat treatment product containing the reactive medium.

TABLE 2

| | Conditions for immobilizing Pd compound | | |
|---|---|---|---|
| | $Al_2O_3$ block (g) | Conditions for immersing $Al_2O_3$ block | Immersion time of $Al_2O_3$ block (min) |
| Comparative Example A1 | 0 | 0 | 0 |
| Example A1 | 0.6 | Immersed in introduced material | 25 |

TABLE 2-continued

| | Conditions for immobilizing Pd compound | | |
|---|---|---|---|
| | $Al_2O_3$ block (g) | Conditions for immersing $Al_2O_3$ block | Immersion time of $Al_2O_3$ block (min) |
| Example A2 | 1 | from start of temperature rising Immersed in introduced material | 25 |
| Example A3 | 1 | from start of temperature rising Immersed in introduced material | 30 |
| Example A4 | 2 | after reaching heating temperature Immersed in introduced material after reaching heating temperature | 30 |

A2. Results

A2-1. Confirmation of Immobilization of Pd Compound on Aluminum Oxide Block

The aluminum oxide block (0.6 g) of Example A1 taken out from the molten product was simply cleaned with ion-exchanged water in a short time, dried, and a surface of the aluminum oxide block was observed by scanning electron microscopy-energy dispersive X-ray spectroscopy (SEM-EDS). FIG. 1 is a diagram showing SEM-EDS images of the surface of the aluminum oxide block. As illustrated in FIG. 1, there were sub-micron order particles on the surface of the aluminum oxide block.

Figure 2:
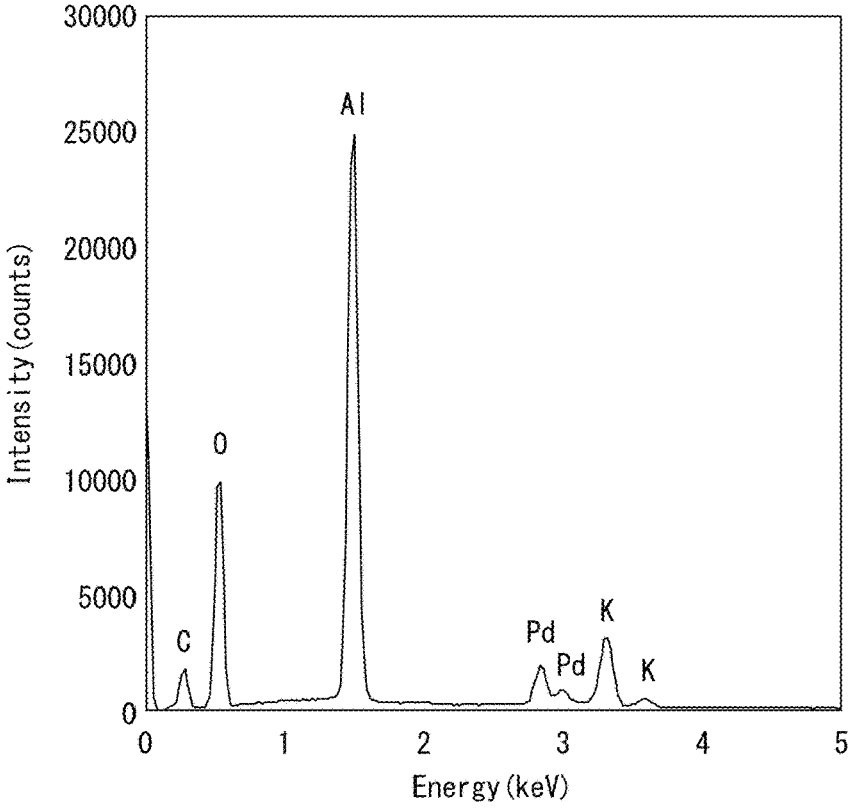
FIG. 2 is a diagram indicating an EDS spectrum of a Pd-concentrated portion on a surface of an aluminum oxide block in one Example.

FIG. 2 is a diagram indicating an EDS spectrum of the sub-micron order particles (portion P in FIG. 1) on the surface of the aluminum oxide block. The results shown in FIG. 2 and the Pd mapping image by EDS shown in FIG. 1 indicated that the particles contained a Pd compound. As described above, the aluminum oxide block observed by SEM-EDS was obtained by removing, by cleaning with ion-exchanged water, salts derived from the reactive medium adhering to the surface. From this, Pd on the aluminum oxide block surface can be regarded as being immobilized by adsorption from the reactive medium to the aluminum oxide block surface. Thus, it has been indicated that, according to the method for recovering a platinum-group metal in accordance with an embodiment of the present invention, a platinum-group compound can be easily isolated from a molten product.

A2-2. Recovery of Pd Compound Immobilized on Aluminum Oxide Block

Figure 3:
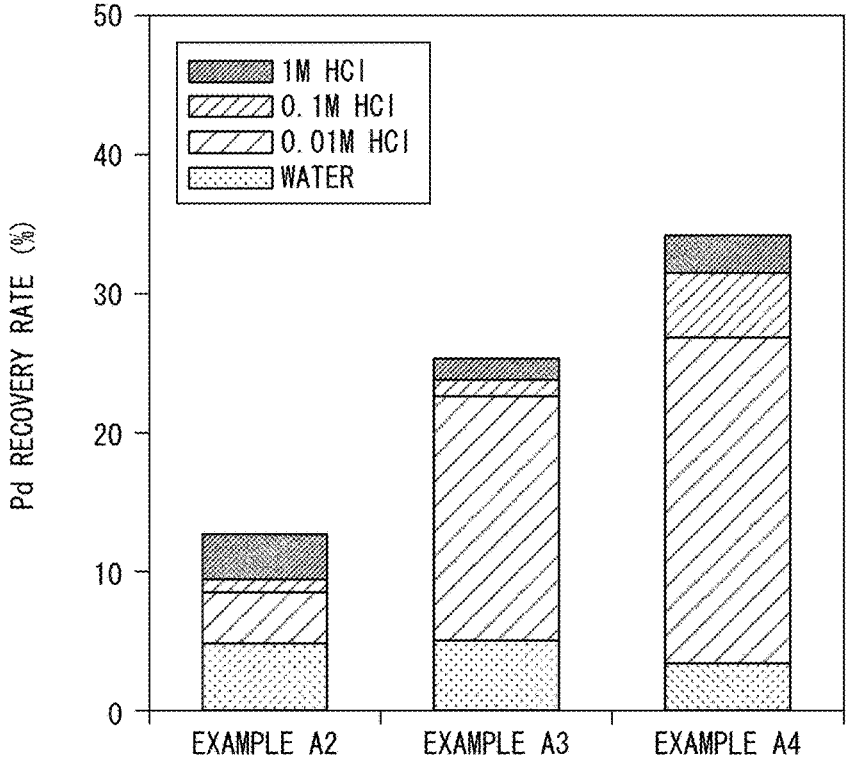
FIG. 3 is a diagram indicating a Pd recovery rate from an aluminum oxide block in one Example.

FIG. 3 is a diagram indicating a Pd recovery rate from an aluminum oxide block when the elution treatment was carried out with respect to aluminum oxide blocks of Examples A2 through A4. As shown in (A1-4) above, four types of aqueous solvents were used in a stepwise manner in the elution treatment. In the following evaluation, a sum of Pd elution rates in the respective aqueous solvents was used as an index of the Pd recovery rate.

In Example A2, the aluminum oxide block was introduced into the mixture in the 10 mL crucible at the beginning of heating of the electric furnace in which the 30 mL crucible was placed. Under the conditions of Example A2, the Pd recovery rate was 12%. Meanwhile, in Example A3, the electric furnace was heated to 900° C., and 30 minutes after reaching 900° C., the aluminum oxide block was introduced into the molten product in the 10 mL crucible. Under the conditions of Example A3, the Pd recovery rate was 25%. In Example A4, the elution treatment was carried out under conditions similar to those in Example A3, except that an introduced amount of the aluminum oxide block was set to 2 g. Under the conditions of Example A4, the Pd recovery rate was 33%, which was higher than that of Example A3. As such, it has been indicated that adsorption of the Pd compound on the aluminum oxide block surface can be promoted by altering the immersion conditions, the introduced amounts, and the like of the aluminum oxide blocks.

A2-3. Concentration of Boron in Palladium Lysate

Table 3 below indicates concentrations of the Pd compound and boron in the Pd eluates in Comparative Example A1 and Example A3. In Comparative Example A1, the heat treatment product containing the reactive medium was subjected to the elution treatment using ion-exchanged water to obtain an eluate. A concentration of boron in the eluate was 753 mg/L. On the other hand, a concentration of boron in the eluate using ion-exchanged water in Example A3 was 204 mg/L, and thus the boron concentration was greatly reduced as compared with that of Comparative Example A1. Moreover, concentrations of boron in 0.01M to 1M hydrochloric acid aqueous solutions were in a range of 5.8 mg/L to 9.3 mg/L, and thus the concentrations of boron were further lower than that of Comparative Example A1. Thus, according to the method for recovering a platinum-group metal in accordance with an embodiment of the present invention, it has been indicated that the concentration of a salt of the oxide in the eluate can be effectively reduced.

TABLE 3

| | | Component concentration in eluate (mg/L) | |
|---|---|---|---|
| | Eluate | B | Pd |
| Comparative Example A1 | Water | 753 | 7.6 |
| Example A3 | Water | 204 | 2 |
| | 0.01M HCl | 6.6 | 6.7 |
| | 0.1M HCl | 5.8 | 0.45 |
| | 1M HCl | 9.3 | 0.61 |

In Example A3, when the aluminum oxide block was taken out from the molten product, a part of the molten product containing the $K_2O$—$B_2O_3$ medium was adhering to the aluminum oxide block. Therefore, it seems that boron derived from the $K_2O$—$B_2O_3$ medium adhered to the aluminum oxide block was eluted in the eluate of ion-exchanged water in the elution treatment. Thus, it seems that transition of boron into the eluate can be further inhibited by heightening separation property between the aluminum oxide block and the $K_2O$—$B_2O_3$ medium and lowering adhesion of the $K_2O$—$B_2O_3$ medium to the aluminum oxide block as described above.

B. Immobilization of Platinum-Group Metal on Aluminum Oxide Powder

B1. Sample and Method

A $K_2O$—$B_2O_3$ medium (1 g) prepared in the same manner as that of (A1-1) above was mixed with a platinum-group metal, potassium carbonate (3.9 g), and aluminum oxide powder (1 g) (which is an example of the ceramic material of the present invention). As the platinum-group metal, 10 mg of a metal Pd or 12 mg of a metal Pt was used. This mixture was introduced into a 10 mL crucible, and the 10 mL crucible was placed in a 30 mL crucible. The 30 mL crucible was heated in an electric furnace. A heating temperature was 900° C. or 600° C. for the mixture containing the metal Pd, and was 900° C. for the mixture containing the metal Pt, and a heating time was 30 minutes. By the heating, a platinum-group compound which is an oxidation product of the platinum-group metal was dissolved in the $K_2O$—$B_2O_3$ medium. After that, the platinum-group compound dissolved in the molten product was immobilized on the aluminum oxide powder surface. Then, a mixture of the aluminum oxide powder and the molten product was obtained.

The mixture of the aluminum oxide powder and the molten product was immersed in 150 mL of ion-exchanged water for 2 hours to be cleaned, and a surface state of the aluminum oxide powder was analyzed. An immobilization state of the platinum-group metal on the aluminum oxide powder surface was analyzed by SEM-EDS, an X-ray diffractometer (XRD), or a photoelectron spectrometer (XPS).

B2. Results

B2-1. Confirmation of Immobilization of Pd Compound on Aluminum Oxide Powder Heated at 900° C.

Figure 4:
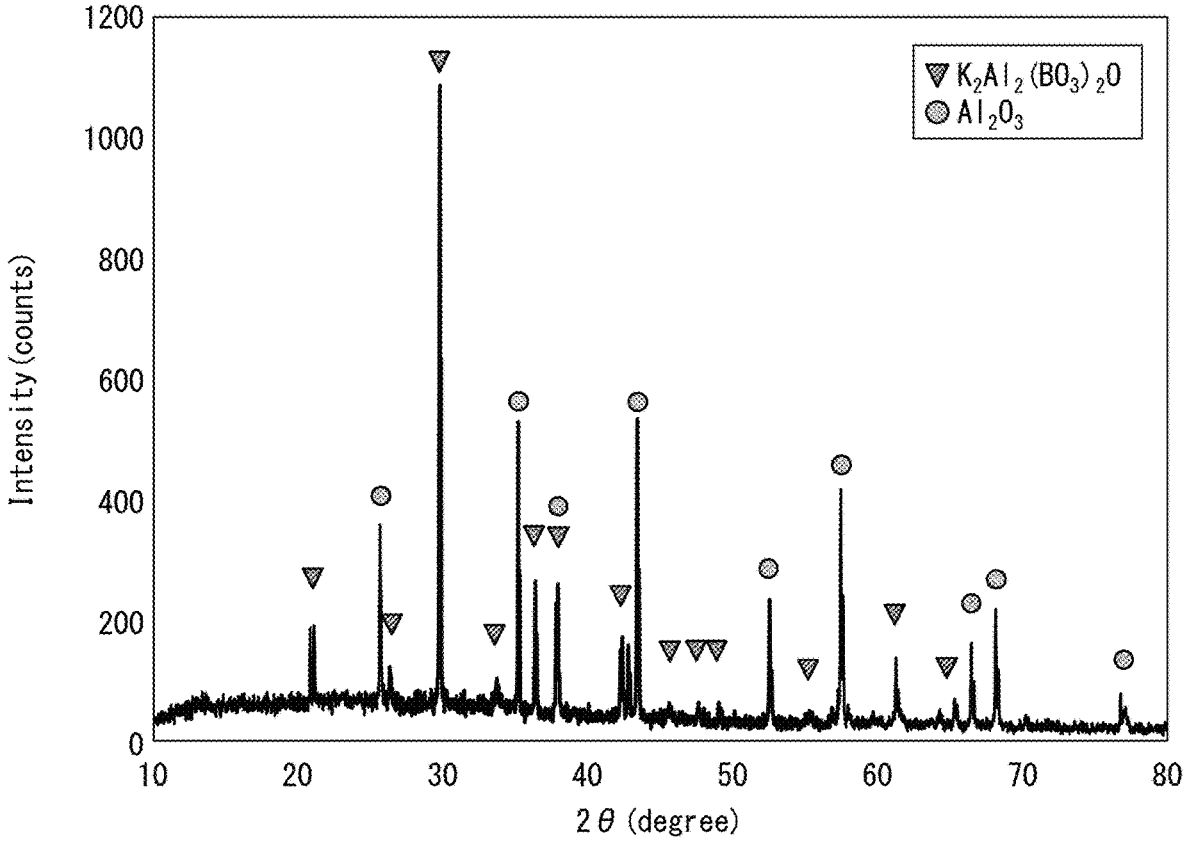
FIG. 4 is a diagram indicating an XRD-diffraction pattern of Pd-adsorbed aluminum oxide powder heated at 900° C. in one Example.

FIG. 4 shows an XRD-diffraction pattern of aluminum oxide powder heated at 900° C. under the condition of containing the metal Pd and then cleaned (Example B1). As illustrated in FIG. 4, the XRD-diffraction pattern of Example B1 included an XRD-diffraction pattern of $Al_2O_3$ (peak group indicated by circles in FIG. 4) and an XRD-diffraction pattern of $K_2Al_2(BO_3)_2O$ (peak group indicated by downward triangles in FIG. 4). From this result, it has been indicated that an immobilization layer containing $K_2Al_2(BO_3)_2O$ was formed on the aluminum oxide powder surface in Example B1.

Figure 5:
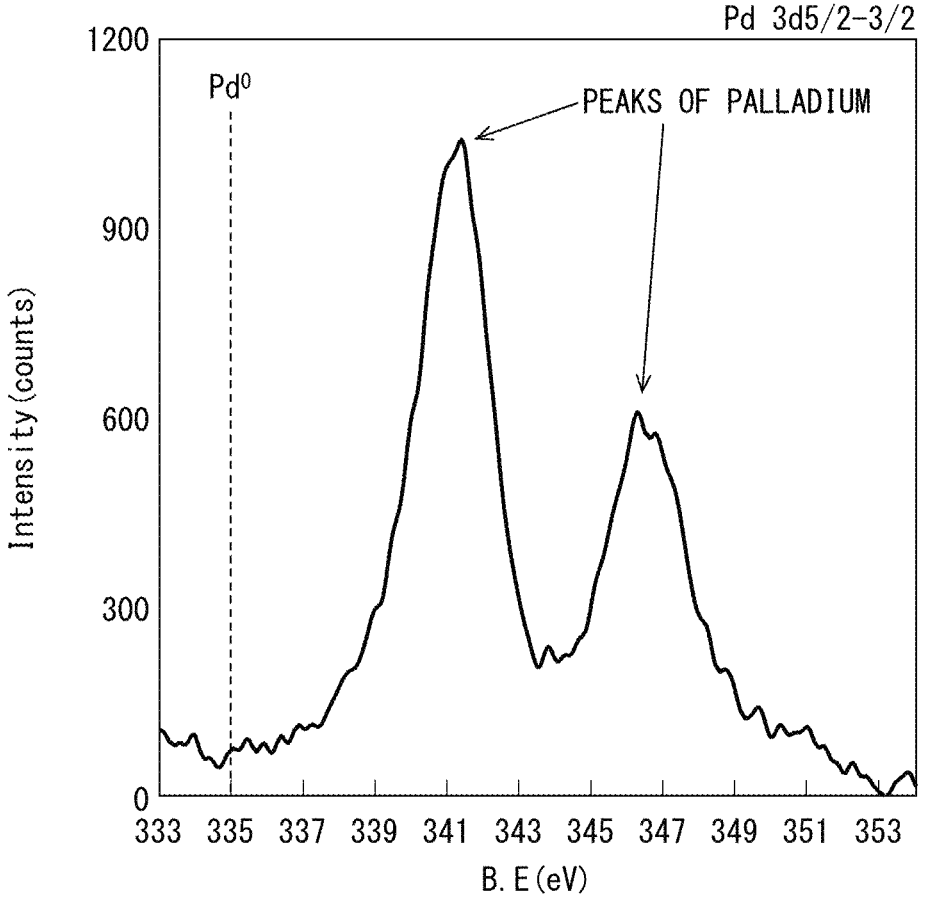
FIG. 5 is a diagram indicating an XPS spectrum of Pd-adsorbed aluminum oxide powder in one Example.

FIG. 5 shows an XPS spectrum of the aluminum oxide powder in Example B1. As illustrated in FIG. 5, peaks indicating Pd were observed in the XPS spectrum of Example B1. The peaks indicating Pd were shifted from a position of an ordinary peak of the metal Pd (i.e., a peak indicated by $Pd^0$ in FIG. 5) to a higher energy side. This is a result suggesting that Pd is present on the aluminum oxide powder surface in an oxidized state.

The above results suggest that an immobilization layer containing $K_2Al_2(BO_3)_2O$ was formed on the aluminum oxide powder surface in Example B1 in which the heating temperature in the molten product was set at 900° C., and Pd was immobilized in the immobilization layer.

B2-2. Confirmation of Immobilization of Pd Compound on Aluminum Oxide Powder Heated at 600° C.

Figure 6:
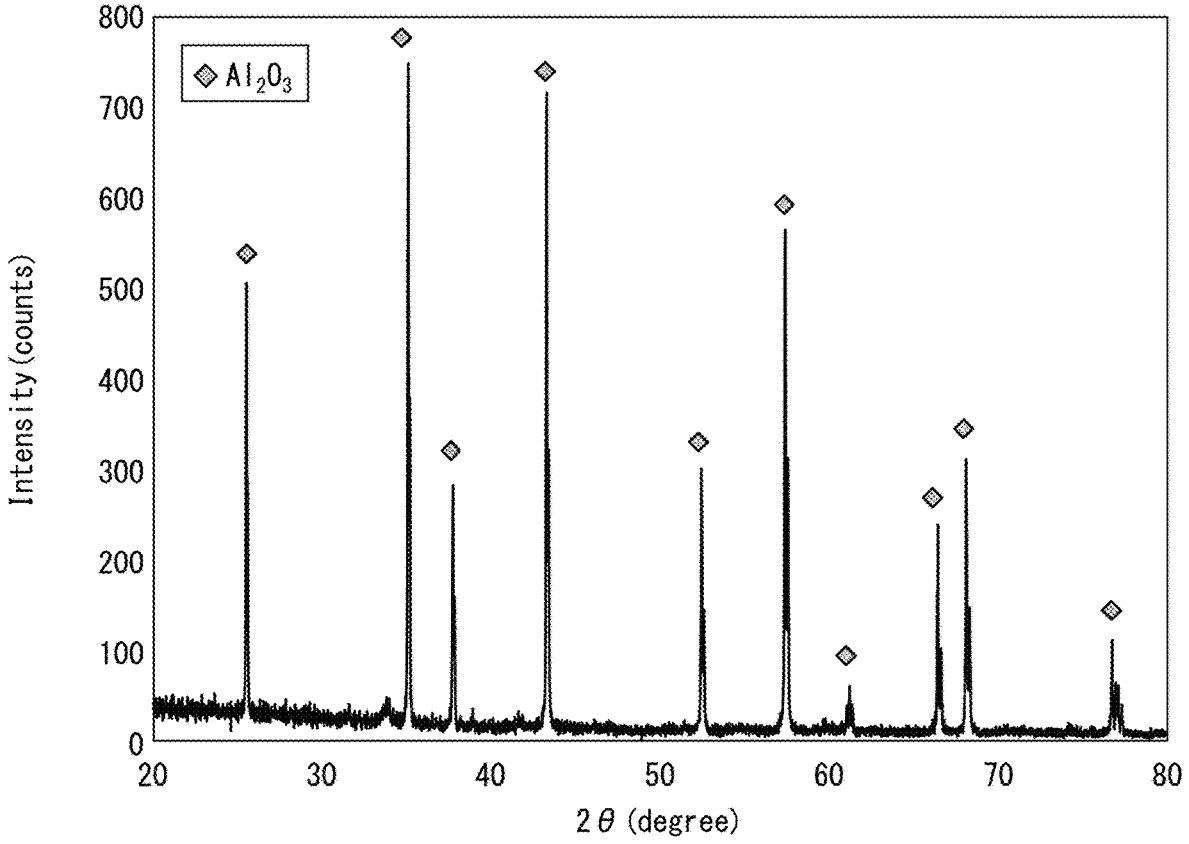
FIG. 6 is a diagram indicating an XRD-diffraction pattern of Pd-adsorbed aluminum oxide powder heated at 600° C. in one Example.

FIG. 6 shows an XRD-diffraction pattern of aluminum oxide powder heated at 600° C. under the condition of containing the metal Pd (Example B2). As illustrated in FIG. 6, when the heating temperature was 600° C., the XRD-diffraction pattern of Example B2 showed an XRD-diffraction pattern of $Al_2O_3$ (peak group indicated by diamonds in FIG. 6), and no peaks indicating other molecules were observed. Then, a surface state of the aluminum oxide powder in Example B2 was observed by SEM-EDS.

Figure 7:
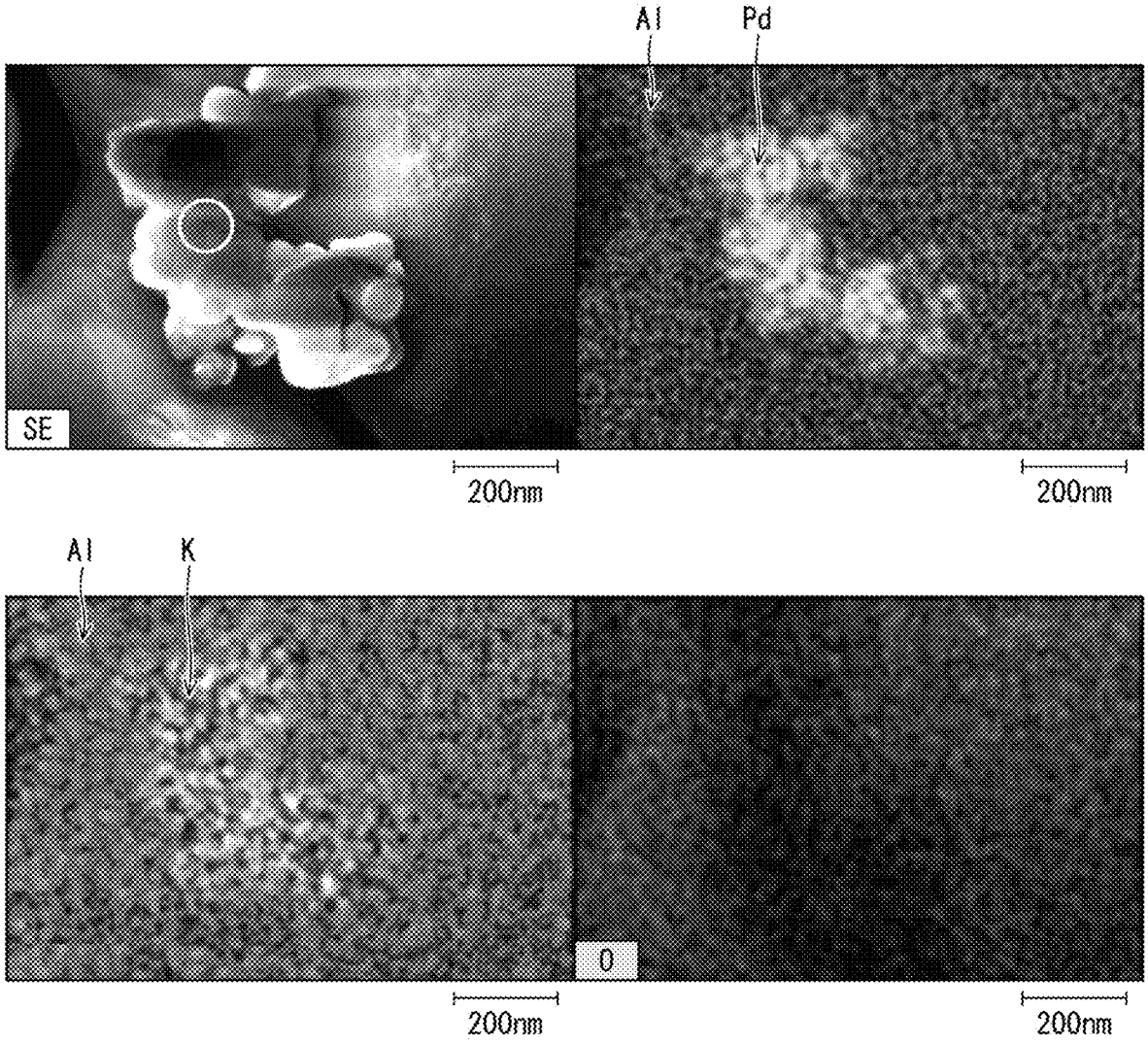
FIG. 7 is a diagram showing SEM-EDS images of a surface of Pd-adsorbed aluminum oxide powder heated at 600° C. in one Example.

FIG. 7 is a diagram showing SEM-EDS images of the aluminum oxide powder surface in Example B2. The upper left image in FIG. 7 shows a secondary electron image of the aluminum oxide powder surface in Example B2, and the other images respectively show element mapping images for elements indicated in FIG. 7. As illustrated in FIG. 7, Pd, K, and O were observed on the aluminum oxide powder surface in Example B2.

Figure 8:
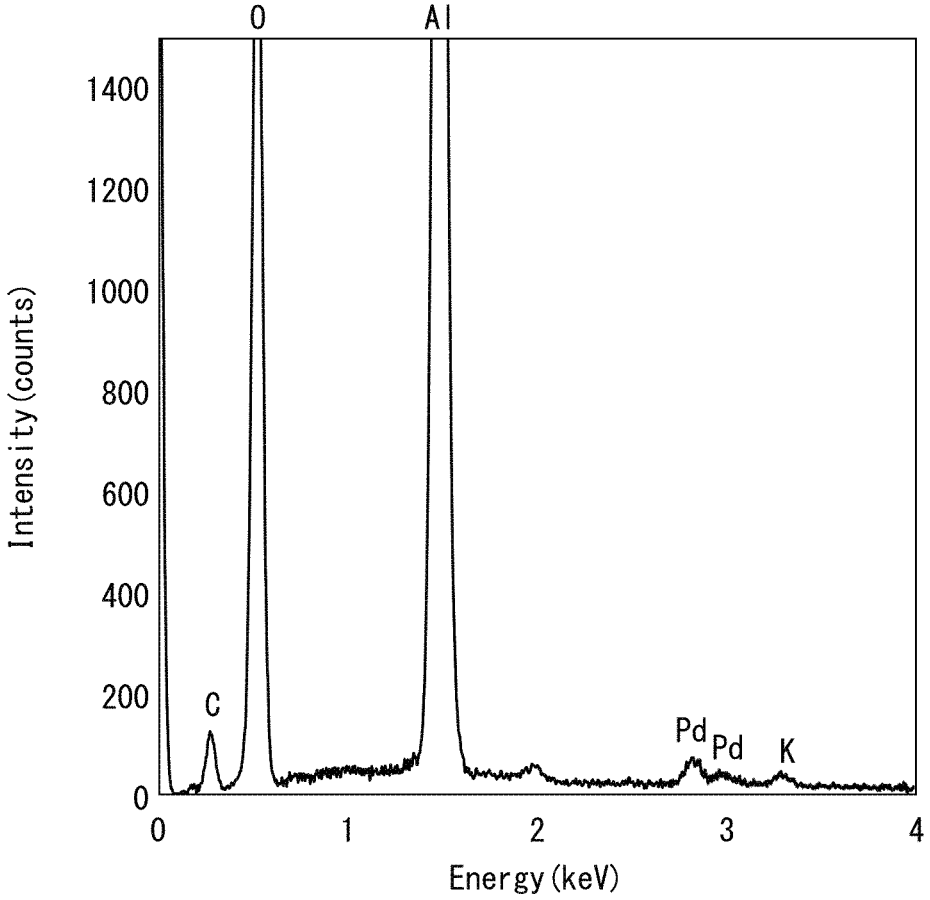
FIG. 8 is a diagram indicating an EDS spectrum of Pd-adsorbed aluminum oxide powder heated at 600° C. in one Example.

FIG. 8 shows an EDS spectrum of the aluminum oxide powder in Example B2. FIG. 8 shows an EDS spectrum of the entire observation area illustrated in FIG. 7. As illustrated in FIG. 8, C, O, Al, Pd, and K were present in the aluminum oxide powder in Example B2. In the upper left image in FIG. 7, 47.4% by weight of O, 32.3% by weight of Al, 19.6% by weight of Pd, and 0.71% by weight of K were present in the range indicated by the round frame. That is, it has been indicated that a complex containing at least Pd, K, Al, and O was formed on the aluminum oxide powder surface in Example B2.

From the above results, it has been indicated that the metal Pd was immobilized on the aluminum oxide powder surface in Example B2 obtained by setting the heating temperature to be 600° C. in the molten product. Therefore, it seems that an immobilization layer which is capable of immobilizing the metal Pd was formed on the aluminum oxide powder surface in Example B2. However, when the heating condition was set to be 600° C., the immobilization layer did not contain a detectable amount of B. That is, it has been indicated that the immobilization layer is capable of immobilizing the metal Pd even in the state of containing no B derived from an oxide.

B2-3. Confirmation of Immobilization of Pt Compound on Aluminum Oxide Powder Heated at 900° C.

Figure 9:
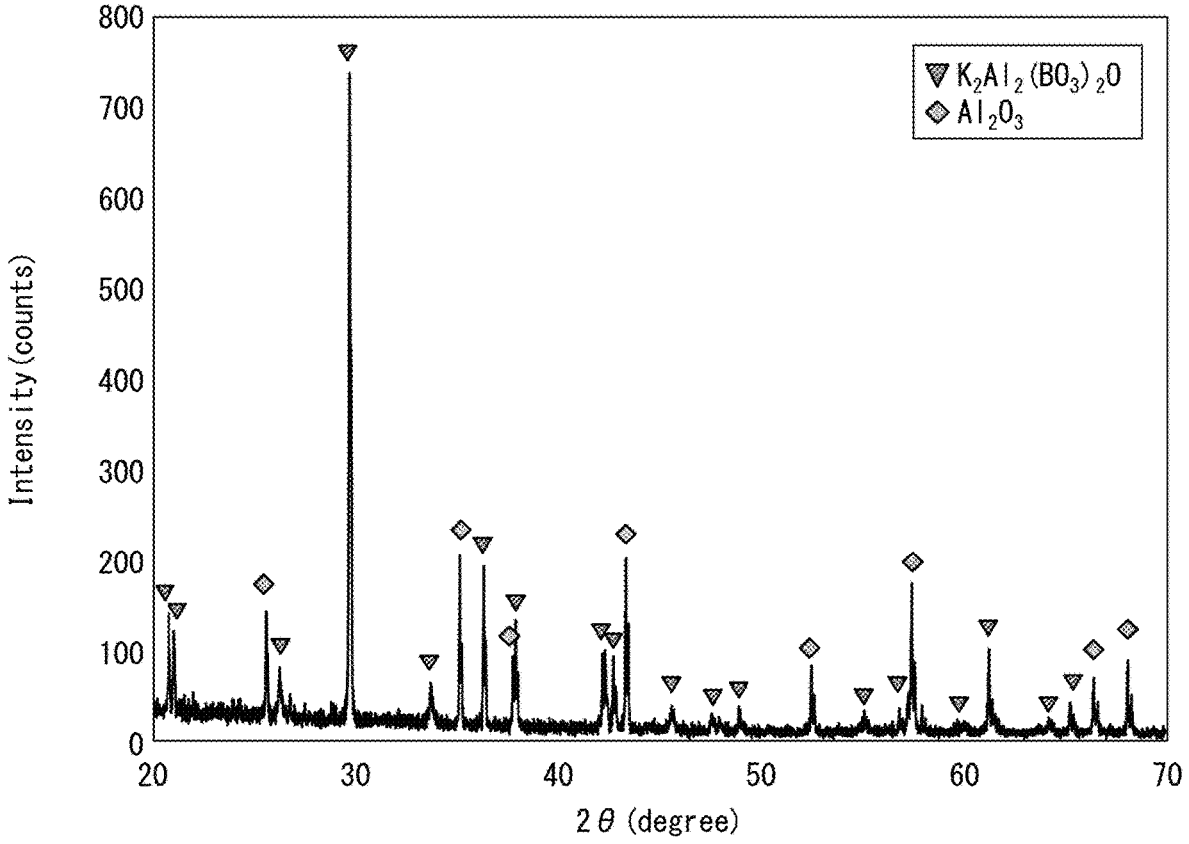
FIG. 9 is a diagram indicating an XRD-diffraction pattern of Pt-adsorbed aluminum oxide powder in one Example.

FIG. 9 shows an XRD-diffraction pattern of aluminum oxide powder heated at 900° C. under the condition of containing the metal Pt and then cleaned (Example B3). As illustrated in FIG. 9, the XRD-diffraction pattern of Example B3 included an XRD-diffraction pattern of $Al_2O_3$ (peak group indicated by diamonds in FIG. 9) and an XRD-diffraction pattern of $K_2Al_2(BO_3)_2O$ (peak group indicated by downward triangles in FIG. 9). From this result, it has been indicated that an immobilization layer containing $K_2Al_2(BO_3)_2O$ was formed on the aluminum oxide powder surface in Example B3.

Figure 10:
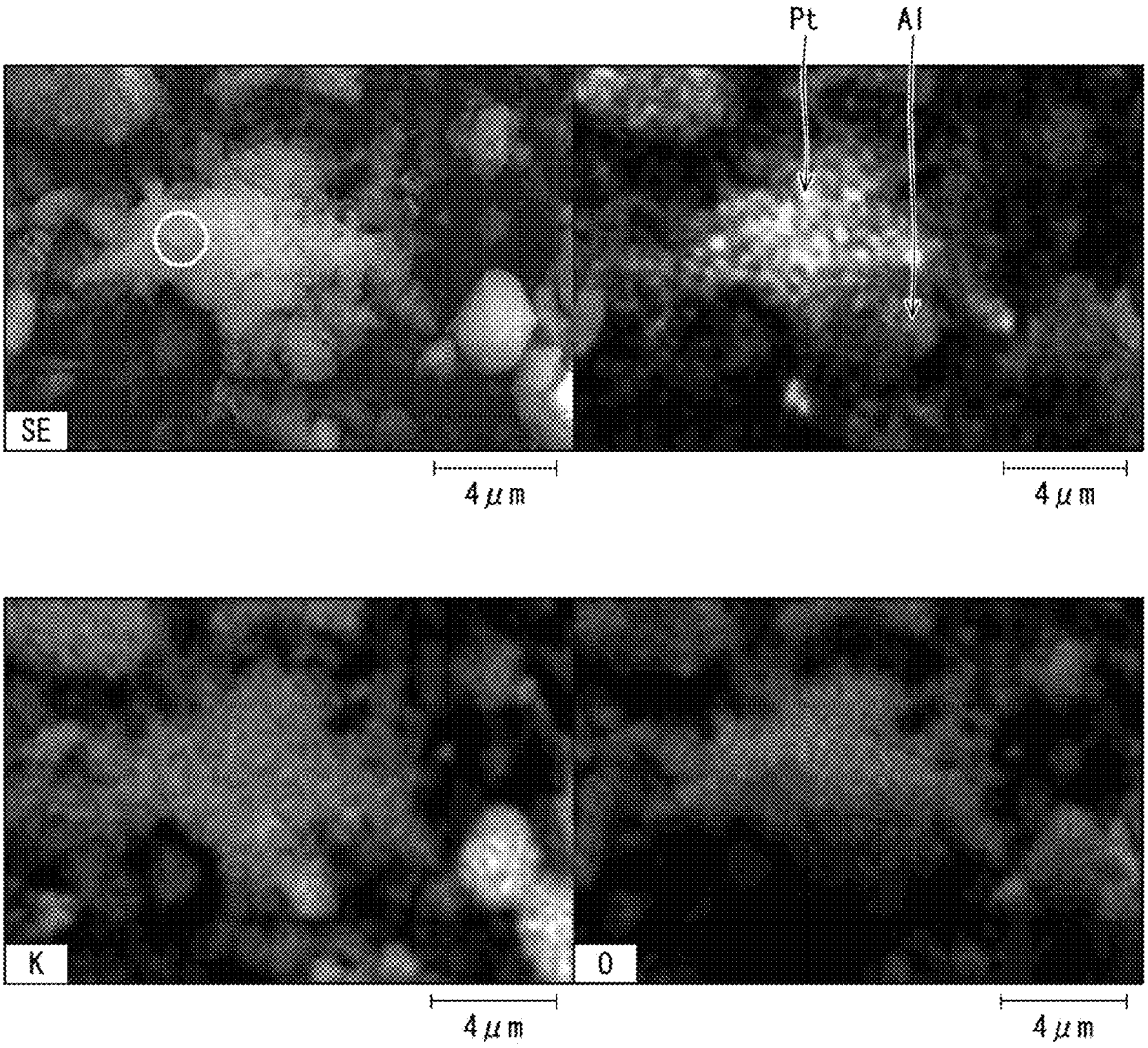
FIG. 10 is a diagram showing SEM-EDS images of a surface of Pt-adsorbed aluminum oxide powder in one Example.

FIG. 10 is a diagram showing SEM-EDS images of the aluminum oxide powder surface in Example B3. The upper left image in FIG. 10 shows a secondary electron image of the aluminum oxide powder surface in Example B3, and the other images respectively show element mapping images for elements indicated in FIG. 10. As illustrated in FIG. 10, Pt, K, and O were observed on the aluminum oxide powder surface in Example B3.

Figure 11:
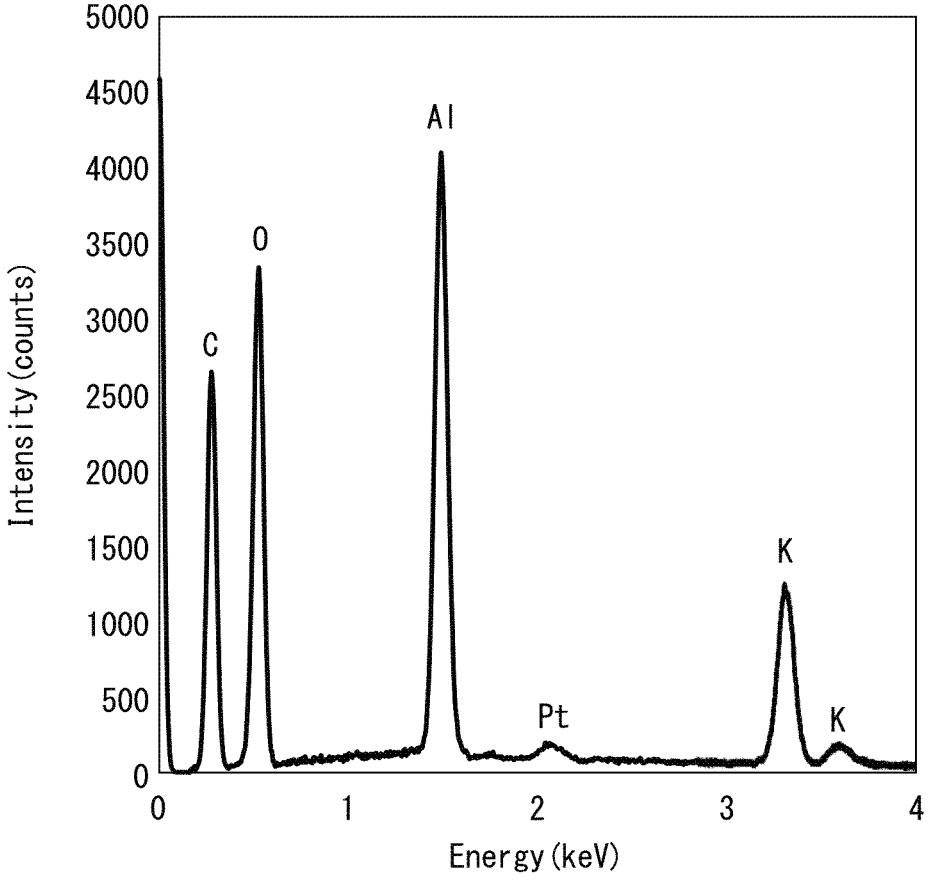
FIG. 11 is a diagram indicating an EDS spectrum of Pt-adsorbed aluminum oxide powder in one Example.

FIG. 11 shows an EDS spectrum of the aluminum oxide powder in Example B3. FIG. 11 shows an EDS spectrum of the entire observation area illustrated in FIG. 10. As illustrated in FIG. 11, C, O, Al, Pt, and K were present in the aluminum oxide powder in Example B3. In the upper left image in FIG. 10, 54.6% by weight of O, 19.7% by weight of Al, 3.2% by weight of Pt, and 9.5% by weight of K were present in the range indicated by the round frame. That is, it has been indicated that a complex containing at least Pt, K, Al, and O was formed on the aluminum oxide powder surface in Example B3.

From the above results, it has been indicated that the metal Pt was immobilized on the aluminum oxide powder surface in Example B3 obtained by setting the heating temperature to be 900° C. in the molten product. Therefore, it has been indicated that the immobilization layer formed on the aluminum oxide powder surface in Example B3 is capable of immobilizing not only the metal Pd but also the metal Pt.

C. Composition of Pd-Containing Composition

C1. Sample and Method

A mixture of aluminum oxide powder, prepared in the same manner as that of (B1-1) above, and a molten product was placed in a 200 mL beaker, and 150 mL of ion-exchanged water was added to the beaker. A stirring rod was immersed in the liquid in the beaker, and the liquid was stirred at a stirring speed of 7000 rpm for 30 minutes. Next, the mixture remaining in the beaker was stirred for 30 minutes in a manner similar to that described above using a 1M hydrochloric acid aqueous solution (1M HCl). The mixture was taken out from an obtained treatment liquid derived from the 1M hydrochloric acid aqueous solution, and 3 g of active carbon was immersed in the treatment liquid. A stirring rod was immersed in the liquid in the beaker, and the liquid was stirred at a stirring speed of 7000 rpm for 30 minutes.

Next, the active carbon was taken out from the beaker, and the active carbon was heated at 1000° C. for 4 hours to burn the active carbon. A Pd concentrate thus obtained after heating (which is an example of the platinum-group metal-containing composition of the present invention) was analyzed by SEM-EDS.

C2. Results

Figure 12:
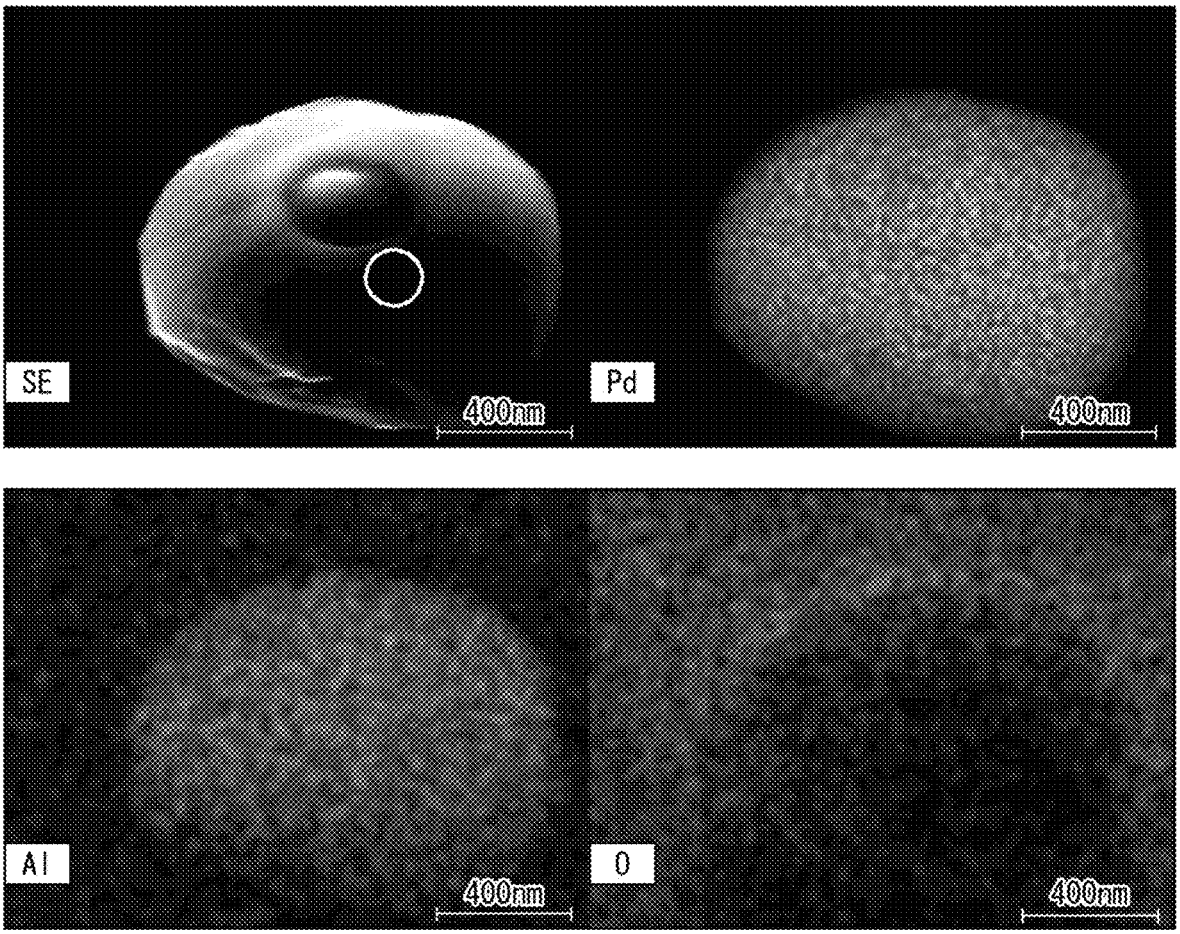
FIG. 12 is a diagram showing SEM-EDS images of a surface of a Pd concentrate in one Example.

FIG. 12 is a diagram showing SEM-EDS images of a surface of the Pd concentrate. The upper left image in FIG. 12 shows a secondary electron image of the Pd concentrate surface, and the other images respectively show element mapping images for elements indicated in FIG. 12. As illustrated in FIG. 12, Pd and O were observed on the Pd concentrate surface.

Figure 13:
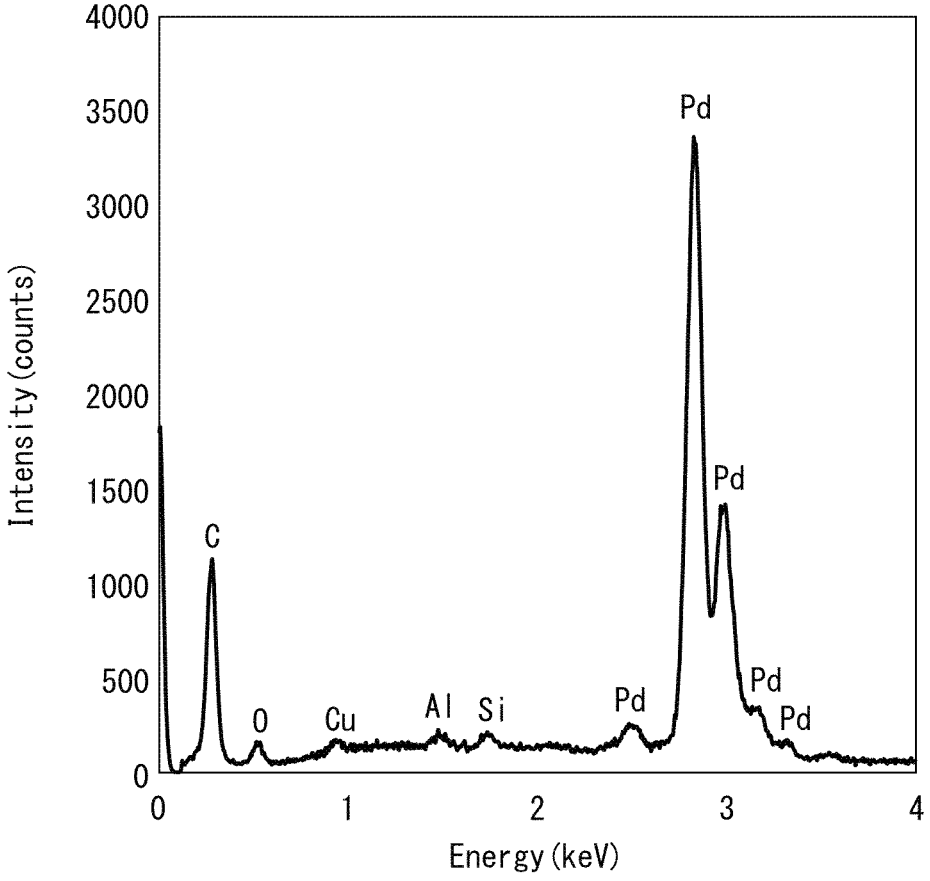
FIG. 13 is a diagram indicating an EDS spectrum of a Pd concentrate in one Example.

FIG. 13 is a diagram indicating an EDS spectrum of the Pd concentrate. FIG. 13 shows an EDS spectrum of the entire observation area illustrated in FIG. 12. As illustrated in FIG. 13, C, O, Cu, Al, Si, and Pd were present in the Pd concentrate. In the upper left image in FIG. 12, 84.48% by weight of Pd, 9.08% by weight of C, 3.71% by weight of 0, 1.9% by weight of Cu, 0.45% by weight of Al, and 0.38% by weight of Si were present in the range indicated by the round frame. Among those, Cu and Si were not added in the molten product, and therefore, Cu and Si seem to be components derived from the active carbon. Moreover, C and O seem to be unburned carbon derived from the active carbon and oxygen bonded to the unburned carbon. Therefore, it seems that a component derived from a molten salt formed in the molten product contained in the Pd concentrate was only Al.

Therefore, among the components detected by the EDS spectrum of the Pd concentrate, when the composition ratio was recalculated only with Pd and Al, the result showed 99.47% by weight of Pd and 0.53% by weight of Al.

As such, it has been indicated that the platinum-group metal-containing composition obtained by the method for recovering a platinum-group metal in accordance with an embodiment of the present invention contains a platinum-group metal and an amphoteric element. In addition, it has been indicated that such a platinum-group metal-containing composition contains not less than 99% by weight of the platinum-group metal, where a total amount of the platinum group metal and the amphoteric element is 100% by weight.

D. Platinum-Group Metal Other than Pd and Ceramic Material Other than Aluminum Oxide

D1. Sample and Method

D1-1. Preparation of Platinum-Group Compound

A $K_2O$—$B_2O_3$ medium (1 g) prepared in the same manner as that of (A1-1) above was mixed with a platinum-group metal (metal Pt or metal Rh) (10 mg) and potassium carbonate (3.9 g). This mixture was introduced into a 10 mL crucible, and the 10 mL crucible was placed in a 30 mL crucible. The 30 mL crucible was heated in an electric furnace. The 10 mL crucible here was provided with pores smaller than diameters of alumina spheres or zirconia spheres. A heating temperature was 900° C. or 1000° C., and a heating time was 30 minutes. By the heating, a platinum-group compound which is an oxidation product of the platinum-group metal is dissolved in the $K_2O$—$B_2O_3$ medium. After that, the ceramic material was immersed for a predetermined time period (immersion time) in the molten product in which the platinum-group compound was dissolved. As the ceramic material, 10 alumina spheres having a diameter of approximately 4 mm or 10 zirconia spheres having a diameter of 2.8 mm to 3.2 mm were used. Those alumina spheres and zirconia spheres are examples of the ceramic material of the present invention. After that, the 10 mL crucible accommodating the alumina spheres or zirconia spheres was taken out from the molten product.

D1-2. Evaluation of Recovery Rate of Platinum-Group Compound

In order to evaluate an amount of the platinum-group compound immobilized on the ceramic material surface, the following test was carried out. The crucible accommodating the ceramic material was placed in a 200 mL beaker, and 150 mL of ion-exchanged water was added to the beaker (elution treatment). A stirring rod was immersed in the liquid in the beaker, and the liquid was stirred at a stirring speed of 7000 rpm for 30 minutes. After that, the liquid (eluate) in the beaker was suction-filtered through a 1 μm paper filter.

Meanwhile, for the ceramic material remaining in the beaker after filtration, an elution treatment, stirring, and filtration were carried out in manners similar to those described above using a 0.01M hydrochloric acid aqueous solution (0.01M HCl). For the alumina spheres in Example D11 and zirconia spheres in Example D12 indicated in Table 4 below, the remaining ceramic material was further subjected to an elution treatment, stirring, and filtration in manners similar to those described above using a 0.1M hydrochloric acid aqueous solution (0.1M HCl) and a 1M hydrochloric acid aqueous solution (1M HCl) in sequence. A concentration of the platinum-group compound in each of the eluates obtained by the series of operations was measured by an ICP emission spectrometer, and a recovery rate of a platinum-group metal was determined from the equation (1) above.

D1-3. Conditions in Examples

In order to clarify a relationship between the type of the platinum-group metal, the type of the ceramic compound, the immobilization condition for the platinum-group compound, and the dissolution rate of the platinum-group compound, the dissolution rate was measured under each of conditions indicated in Table 4 below. In Examples D1 through D10, the metal Pt was used as the platinum-group metal, and the alumina spheres were used as the ceramic material, and the immersion condition of the alumina spheres in the molten product was altered. In Example D11, the metal Rh was used as the platinum-group metal, and the alumina spheres were used as the ceramic material. In Example D12, the metal Pt was used as the platinum-group metal, and the zirconia spheres were used as the ceramic material.

TABLE 4

| | Platinum-metal group | Ceramic material | Heating temperature (° C.) | Immersion time (min) | Dissolution rate of platinum-group metal (%) | | | |
|---|---|---|---|---|---|---|---|---|
| | | | | | Water | 0.01M HCl | 0.1M HCl | 1M HCl |
| Example D1 | Pt | Alumina spheres | 1000 | 60 | 7.1 | 1.20 | — | — |
| Example D2 | Pt | Alumina spheres | 1000 | 45 | 2.6 | 0.62 | — | — |
| Example D3 | Pt | Alumina spheres | 1000 | 30 | 4.2 | 0.53 | — | — |
| Example D4 | Pt | Alumina spheres | 1000 | 10 | 2.4 | 0.64 | — | — |
| Example D5 | Pt | Alumina spheres | 1000 | 5 | 2.9 | 0.30 | — | — |
| Example D6 | Pt | Alumina spheres | 900 | 60 | 3.2 | 0.19 | — | — |
| Example D7 | Pt | Alumina spheres | 900 | 45 | 1.5 | 0.49 | — | — |
| Example D8 | Pt | Alumina spheres | 900 | 30 | 2.1 | 0.36 | — | — |
| Example D9 | Pt | Alumina spheres | 900 | 10 | 1.0 | 0.25 | — | — |
| Example D10 | Pt | Alumina spheres | 900 | 5 | 2.3 | 0.13 | — | — |
| Example D11 | Rh | Alumina spheres | 900 | 60 | <0.2 | 0.90 | <0.2 | <0.2 |
| Example D12 | Pt | Zirconia spheres | 900 | 60 | 2.5 | 0.33 | 0.15 | 0.30 |

D2. Results

From the results in Examples D1 through D12, it has been indicated that the method for recovering a platinum-group metal in accordance with an embodiment of the present invention can also recover the metal Pt and the metal Rh using the aqueous solvent. That is, it has been indicated that the metal Pt and the metal Rh can be immobilized by the immobilization layer formed on the surface of the ceramic material.

As indicated in Example D1 and the like, the metal Pt was mainly eluted from the surface of the ceramic material by the ion-exchanged water. Meanwhile, as shown in Example D11, the metal Rh was hardly eluted by the ion-exchanged water, and was effectively eluted by the 0.01M hydrochloric acid aqueous solution. Thus, it has been indicated that, although the optimal elution conditions differ in accordance with the type of the platinum-group metal, the platinum-group metal can be efficiently recovered from the surface of the ceramic material by the aqueous solvent regardless of the type of the platinum-group metal. It has also been indicated that different types of platinum-group metals can be separately recovered by using a plurality of types of aqueous solvents.

Moreover, as shown in Example D12, the ceramic material is not limited to aluminum oxide, and various ceramic materials such as zirconia are applicable to the method for recovering a platinum-group metal in accordance with an embodiment of the present invention and the like.

E. Types of Hydroxide of Alkali Metal and Oxide

E1-1. Sample and Method

As a molten product of an oxide, 1 g of a $K_2O$—$B_2O_3$ medium prepared in the same manner as that in (A1-1) above (Example E1) or 0.5 g of phosphorus oxide ($P_2O_5$) (Example E2) was mixed with 11 mg of a metal Pt and 4.4 g of potassium hydroxide. This mixture was introduced into a 10 mL crucible, and the 10 mL crucible was placed in a 30 mL crucible. The 30 mL crucible was heated in an electric furnace. The 10 mL crucible here was provided with pores smaller than diameters of alumina spheres or zirconia spheres. A heating temperature was 900° C., and a heating time was 30 minutes. By the heating, a Pt compound which is an oxidation product of the metal Pt is dissolved in the molten product of the oxide. After that, 10 alumina spheres (which are an example of the ceramic material) having a diameter of approximately 4 mm were immersed for 60 minutes in the molten product in which the Pt compound was dissolved. After that, the 10 mL crucible accommodating the alumina spheres was taken out from the molten product in Example E1, and only the alumina spheres were taken out from the molten product in Example E2.

E1-2. Evaluation of Recovery Rate of Pt Compound

In order to evaluate an amount of the Pt compound immobilized on the surfaces of the alumina spheres, the following test was carried out. The crucible accommodating the alumina spheres (Example E1) or only the alumina spheres (Example E2) were placed in a 200 mL beaker, and 150 mL of ion-exchanged water was added to the beaker (elution treatment). A stirring rod was immersed in the liquid in the beaker, and the liquid was stirred at a stirring speed of 7000 rpm for 30 minutes. After that, the liquid (eluate) in the beaker was suction-filtered through a 1 μm paper filter.

Meanwhile, for the alumina spheres remaining in the beaker after filtration, an elution treatment, stirring, and filtration were carried out in sequence in manners similar to those described above using a 0.01M hydrochloric acid aqueous solution (0.01M HCl), a 0.1M hydrochloric acid aqueous solution (0.1M HCl), and a 1M hydrochloric acid aqueous solution (1M HCl). A concentration of the Pt compound in each of the eluates obtained by the series of operations was measured by an ICP emission spectrometer, and a recovery rate of the metal Pt was determined from the equation (1) above.

E2. Results

The results of Example E1 and Example E2 are indicated in Table 5 below.

TABLE 5

| | Dissolution rate of Pt compound (%) | | | |
|---|---|---|---|---|
| | Water | 0.01M HCl | 0.1M HCl | 1M HCl |
| Example E1 | 28.0 | <0.2 | 6.2 | 2.3 |
| Example E2 | 2.0 | 1.80 | 3.0 | 0.66 |

From the results of Example E1 and Example E2, it has been indicated that not only a carbonate of an alkali metal but also a hydroxide of an alkali metal is applicable in the method for recovering a platinum-group metal in accordance with an embodiment of the present invention. Moreover, from the result of Example E2, it has also been indicated that the oxide is not limited to the $K_2O$—$B_2O_3$ medium, and the method for recovering a platinum-group metal in accordance with an embodiment of the present invention can be carried out even with use of, for example, phosphorus oxide ($P_2O_5$).

Note that the carbonate or hydroxide of an alkali metal functions as an oxidizer for oxidizing a platinum-group metal, as described above. Other than K, even in a case where Na, Li, Rb or Cs is used as an alkali metal, such an alkali metal functions as an oxidizer as with K, and a soluble platinum-group compound is formed in a medium. Therefore, a carbonate or hydroxide of Na, Li, Rb or Cs is considered to function suitably as an oxidizer, as with a carbonate or hydroxide of K.

The present invention is not limited to the embodiments and Examples described above, but may be altered in various ways by a skilled person within the scope of the claims. Any embodiment based on a proper combination of technical means disclosed in different embodiments and Examples is also encompassed in the technical scope of the present invention.

INDUSTRIAL APPLICABILITY

The present invention can be utilized for recovery of a platinum-group metal from a raw material (e.g., a waste catalyst, and the like) containing a platinum-group metal.

What is claimed:

1. A method for recovering a platinum-group metal, said method comprising:

an immobilization step of causing a molten product of a raw material containing a platinum-group metal, a molten product of a carbonate or hydroxide of an alkali metal, a molten product of an oxide, and a ceramic material to make contact with each other so as to immobilize the platinum-group metal on the ceramic material.

2. The method as set forth in claim 1, wherein:

the immobilization step encompasses causing the ceramic material to adsorb the platinum-group metal or causing a component eluted from the ceramic material and the platinum-group metal to coprecipitate.

3. The method as set forth in claim 1, wherein:

in the immobilization step, the raw material containing the platinum-group metal, the carbonate or hydroxide of the alkali metal, and the oxide are heated to obtain a mixture of the molten products, and then the mixture of the molten products is brought into contact with the ceramic material.

4. The method as set forth in claim 1, wherein:

in the immobilization step, a mixture of the raw material containing the platinum-group metal, the carbonate or hydroxide of the alkali metal, the oxide, and the ceramic material is obtained, and then the mixture of the raw material is heated to obtain a mixture of the molten products such that the mixture of the molten products is in contact with the ceramic material.

5. The method as set forth in claim 1, wherein:

the ceramic material contains aluminum oxide, zeolite, zirconia, silica, iron oxide, cobalt oxide, or nickel oxide.

6. The method as set forth in claim 1, further comprising:

an elution step of bringing the ceramic material, on which the platinum-group metal has been immobilized in the immobilization step, into contact with an aqueous solvent to elute the platinum-group metal from the ceramic material.

7. The method as set forth in claim 1, wherein:

the contacting of the molten products with the ceramic material is carried out at a temperature of 600° C. to 1100° C.

8. The method as set forth in claim 1, wherein:

the contacting of the molten products with the ceramic material is carried out in the presence of an oxoanion of an amphoteric element.

9. The method as set forth in claim 1, wherein the platinum-group metal is Pd, Pt, Rh, Ir, Os, or Ru.

10. The method as set forth in claim 1, wherein the alkali metal is Na, K, Li, Rb, or Cs.

11. The method as set forth in claim 1, wherein:

the oxide is at least one selected from the group consisting of $Na_2O$, $B_2O_3$, $K_2O$, $SiO_2$, $Li_2O$, $Rb_2O$, $Cs_2O$, and $P_2O_5$.

12. The method as set forth in claim 6, wherein the aqueous solvent is an aqueous solution of an acid.

* * * * *